US007338366B2

(12) United States Patent
Rosander et al.

(10) Patent No.: US 7,338,366 B2
(45) **Date of Patent: *Mar. 4, 2008**

(54) GAMING DEVICE HAVING A MECHANICAL SECONDARY DISPLAY

(75) Inventors: Tai Rosander, Reno, NV (US); Randall D. Mead, Reno, NV (US); Markus Rothkranz, Las Vegas, NV (US)

(73) Assignee: IGT, Reno, NV (US)

( * ) Notice: Subject to any disclaimer, the term of this patent is extended or adjusted under 35 U.S.C. 154(b) by 910 days.

This patent is subject to a terminal disclaimer.

(21) Appl. No.: 10/661,685

(22) Filed: Sep. 11, 2003

(65) Prior Publication Data

US 2004/0121840 A1 Jun. 24, 2004

Related U.S. Application Data

(63) Continuation-in-part of application No. 10/243,049, filed on Sep. 12, 2002, now Pat. No. 7,247,093.

(51) Int. Cl.
*A63F 9/24* (2006.01)

(52) U.S. Cl. ..... 463/16

(58) Field of Classification Search ..... 463/12, 463/16–20; 273/369, 143 R

See application file for complete search history.

(56) References Cited

U.S. PATENT DOCUMENTS 366,510 A 7/1887 Criado
454,844 A 6/1891 Brewerton
483,715 A 10/1892 Fisher
1,527,704 A * 2/1925 Ray ..... 40/492
2,545,644 A 3/1951 Benton et al.
3,854,230 A 12/1974 Knaus
3,795,022 A 8/1976 Figueroa
4,321,673 A 3/1982 Hawwass et al.

(Continued)

FOREIGN PATENT DOCUMENTS

DE 38 04 862 A 10/1988

(Continued)

OTHER PUBLICATIONS

Marshall Fey, Slot Machines a Pictorial History of the First 100 Years, Fifth Edition, Fifth Printing on 1997, p. 12,.*

(Continued)

*Primary Examiner*—Corbett B. Coburn
*Assistant Examiner*—Jasson H. Yoo
(74) *Attorney, Agent, or Firm*—Bell, Boyd & Lloyd LLP

(57) ABSTRACT

A gaming device having a mechanical display device for indicating selected symbols to a player. The mechanical display has a plurality of display plates which each display a symbol. In one embodiment, a first set of the display plates and a second set of the display plates are in opposing relation to each other and connected to a housing. The first and second display plates are each independently rotatably connected to the housing and rotate toward and away from each other. The gaming device selects at least one of the symbols on one of the display plates of the first and second set of display plates and displays the selected symbols to the player.

42 Claims, 13 Drawing Sheets

U.S. PATENT DOCUMENTS 4,410,178 A 10/1983 Partridge
4,695,053 A 9/1987 Vazquez, Jr. et al.
4,722,527 A * 2/1988 Gauselmann ..... 273/143 R
4,732,386 A 3/1988 Rayfiel
4,775,155 A 10/1988 Lees
5,031,346 A 7/1991 Herring
5,046,737 A 9/1991 Fienberg
5,102,137 A 4/1992 Ekiert
5,152,529 A 10/1992 Okada
5,205,555 A 4/1993 Hamano
5,342,047 A 8/1994 Heidel et al.
5,364,100 A 11/1994 Ludlow et al.
5,395,111 A 3/1995 Inoue
5,449,173 A 9/1995 Thomas et al.
5,536,016 A 7/1996 Thompson
5,560,603 A 10/1996 Seelig et al.
5,584,763 A 12/1996 Kelly et al.
5,611,535 A 3/1997 Tiberio
5,664,998 A 9/1997 Seelig et al.
5,766,074 A 6/1998 Cannon et al.
5,788,573 A 8/1998 Baerlocher et al.
5,823,872 A 10/1998 Prather et al.
5,823,874 A 10/1998 Adams et al.
D400,597 S 11/1998 Hedrick et al.
D402,702 S 12/1998 Seelig et al.
5,848,932 A 12/1998 Adams
5,851,148 A 12/1998 Brune et al.
5,855,514 A 1/1999 Kamille
5,873,781 A 2/1999 Keane
D406,865 S 3/1999 Heidel
5,882,261 A 3/1999 Adams
5,911,418 A 6/1999 Adams et al.
5,927,714 A 7/1999 Kaplan
5,947,820 A 9/1999 Morro et al.
5,976,015 A 11/1999 Seelig et al.
5,984,781 A 11/1999 Sunaga
5,996,997 A 12/1999 Kamille
5,997,401 A 12/1999 Crawford
6,004,207 A 12/1999 Wilson, Jr. et al.
6,015,346 A 1/2000 Bennett
6,033,307 A 3/2000 Vancura
6,059,289 A 5/2000 Vancura
6,059,658 A 5/2000 Mangano et al.
6,086,066 A 7/2000 Takeuchi et al.
6,089,976 A 7/2000 Schneider et al.
6,089,977 A 7/2000 Bennett
6,089,978 A 7/2000 Adams et al.
6,102,798 A 8/2000 Bennett
6,105,962 A 8/2000 Malavazos et al.
6,113,098 A 9/2000 Adams
6,126,542 A 10/2000 Fier
6,142,873 A 11/2000 Weiss et al.
6,142,874 A 11/2000 Kodachi et al.
6,149,156 A 11/2000 Feola
6,155,925 A 12/2000 Giobbi et al.
6,159,095 A 12/2000 Frohm et al.
6,159,097 A 12/2000 Gura
6,159,098 A 12/2000 Slomiany et al.
6,162,121 A 12/2000 Morro et al.
6,168,523 B1 1/2001 Piechowiak et al.
6,173,955 B1 1/2001 Perrie et al.
6,174,234 B1 1/2001 Seibert, Jr. et al.
6,174,235 B1 1/2001 Walker et al.
6,190,254 B1 2/2001 Bennett
6,190,255 B1 2/2001 Thomas et al.
6,203,429 B1 3/2001 Demar et al.
D441,031 S 4/2001 Seelig et al.
6,213,876 B1 4/2001 Moore, Jr.
6,220,593 B1 4/2001 Pierce et al.
6,224,483 B1 5/2001 Mayeroff
6,227,970 B1 5/2001 Shimizu et al.
6,231,442 B1 5/2001 Mayeroff
6,231,445 B1 5/2001 Acres
D443,313 S 6/2001 Brettschneider
6,251,013 B1 6/2001 Bennett
6,254,481 B1 7/2001 Jaffe
6,260,296 B1 7/2001 Carney, Jr.
6,261,177 B1 7/2001 Bennett
6,267,669 B1 7/2001 Luciano, Jr. et al.
6,270,411 B1 8/2001 Gura et al.
6,299,165 B1 10/2001 Nagano
6,302,790 B1 10/2001 Brossard
6,305,686 B1 10/2001 Perrie et al.
6,309,300 B1 10/2001 Glavich
6,312,334 B1 11/2001 Yoseloff
6,315,660 B1 11/2001 DeMar et al.
6,315,663 B1 11/2001 Sakamoto
6,315,664 B1 11/2001 Baerlocher et al.
6,319,124 B1 11/2001 Baerlocher et al.
6,336,863 B1 1/2002 Baerlocher et al.
6,340,158 B2 1/2002 Pierce et al.
6,343,988 B1 2/2002 Walker et al.
6,346,043 B1 2/2002 Colin et al.
6,347,996 B1 2/2002 Gilmore et al.
6,364,766 B1 4/2002 Anderson et al.
6,364,767 B1 4/2002 Brossard et al.
6,368,216 B1 4/2002 Hedrick et al.
6,386,974 B1 5/2002 Adams
6,398,220 B1 6/2002 Inoue
6,419,579 B1 7/2002 Bennett et al.
6,439,995 B1 8/2002 Hughs-Baird et al.
6,457,714 B1 10/2002 Feola
6,461,241 B1 10/2002 Webb et al.
6,464,582 B1 10/2002 Baerlocher et al.
D465,531 S 11/2002 Luciano, Jr. et al.
6,481,713 B2 11/2002 Perrie et al.
6,506,118 B1 1/2003 Baerlocher et al.
6,514,141 B1 2/2003 Kaminkow et al.
6,533,660 B2 3/2003 Seelig et al.
6,537,152 B2 3/2003 Seelig et al.
6,575,830 B2 6/2003 Baerlocher et al.
6,582,307 B2 6/2003 Webb
6,585,591 B1 7/2003 Baerlocher et al.
6,599,185 B1 7/2003 Kaminkow et al.
6,602,137 B2 8/2003 Kaminkow et al.
6,609,972 B2 8/2003 Seelig et al.
6,712,694 B1 3/2004 Nordman
6,731,313 B1 5/2004 Kaminkow
6,802,775 B2 10/2004 Baerlocher et al.
2003/0064806 A1* 4/2003 Gordon et al. ..... 463/42

FOREIGN PATENT DOCUMENTS

DE 38 11 301 A 10/1989
DE 44 02 800 A 8/1995
EP 0688002 A1 12/1995
EP 0945837 A2 9/1999
EP 0984409 A2 3/2000
GB 371 199 A 4/1932
GB 762 611 A 11/1956
GB 912685 12/1962
GB 2117952 A 10/1983
GB 2201821 A 9/1987
GB 2262642 A 6/1993
GB 2383668 A 11/2001
JP 08 160893 A 6/1996
JP 08 215404 A 8/1996
JP 10 328399 A 12/1998

OTHER PUBLICATIONS

Addams Family Article written by Strictly Slots, published in 2000.
Caribbean Gold Brochure written by Aristocrat, published in 1998.
Jackpot Party Brochures and Articles written WMS Gaming, Inc., published in 1998.

Sphinx Brochure, written by Atronic Casino Technology, published in 1997.
4DU Dice Unit advertisement written by starpoint.uk.com, printed on Sep. 3, 2002.
American Bandstand advertisement written by Anchor Games, published in 2001.
Big Shot!™ advertisement published by Aristocrat Technologies, Inc., published in 2002.
Big Top Keno advertisement published by Aristocrat Technologies, Inc., published in 2000.
Bonus Roulette advertisement written by R. Franco, published before Sep. 11, 2003.
Buck's Roulette advertisement written by R. Franco, published before Sep. 11, 2003.
Chariot's of Fortune advertisement written by R. Franco, published before Sep. 11, 2003.
Classic Pot of Gold advertisement written by Ace Coin Equipment Ltd., published before Sep. 11, 2003.
Cyberdyne Gaming advertisement written by Cyberdyne Gaming, published before Sep. 11, 2003.
Elvira® Mistress of the Dark™ advertisement written by IGT, published in 2002.
Elvis Hits advertisement written by IGT, published in 1999.
Holy Smoke advertisement written by Impulse Gaming Ltd., published before Sep. 11, 2003.
Jack and the Beanstalk™ advertisement written by AC Coin & Slot, published before Sep. 11, 2003.
King of the Grill™ advertisement written by AC Coin & Slot, published before Sep. 11, 2003.
Line-Up advertisement written by AC Coin & Slot, published before Sep. 11, 2003.
Little Green Men Jr.™ advertisement written by AC Coin & Slot, published before Sep. 11, 2003.
Little Green Men Jr.™ article written by Strictly Slots, published in Feb. 2003.
Mega Jackpots news article, published before Sep. 11, 2003.
Miss America advertisement written by AC Coin & Slot, published before Sep. 11, 2003.
Mix and Match article written by Strictly Slots, published in Apr. 2002.
Mix and Match advertisement published by AC Coin & Slot, published before Sep. 11, 2003.
Money Grab article written by Strictly Slots, published in Apr. 2001.
Monster Match article written by Strictly Slots, published in Jan. 2002.
On The Money! article written by Strictly Slots, published in Dec. 2000.
Party Time Psycho Cash Beast advertisement written by IGT, published in 1999.
Payout!™ advertisement written by www.csds.com/Gaming/Products/g_Payout.htm, printed on Jan. 15, 2001.
Payout!™ article written by Casino Data Systems, published before Sep. 11, 2003.
Pick a Prize advertisement written by Acres Gaming Incorporated, published prior 2001.
Power Slotto advertisement published by AC Coin & Slot prior to 2002.
Press Your Luck advertisement published by AC Coin & Slot prior to 2002.
Quick Pick Paytime advertisement written by Acres Gaming Incorporated, published prior to 2001.
R&B™ advertisement published by AC Coin & Slot, published before Sep. 11, 2003.
Reel Dice advertisement written by Gerber & Glass, published in 1936.
Royal Roulette advertisement written by Impulse Gaming Ltd., published before Sep. 11, 2003.
Show News IGT Jan. 2003 advertisement, published in Jan. 2003.
Silver City Roundup advertisement published by AC Coin & Slot, published before Sep. 11, 2003.
Slot Machines A Pictorial History of the First 100 Years, 5th edition written by Marshall Fey, published in 1983-1997.
Slot Machine Buyer's Handbook, A Consumer's Guide to Slot Machines written by David L. Saul and Daniel R. Mead, published in 1998.
Slot Machines on Parade, 1st edition written by Robert N. Geddes and illustrated by Daniel R. Mead, published in 1980.
Slots 2003 Part One article written by Melissa Raimondi, published by Strictly Slots in Jan. 2003.
Spin-A-Lot advertisement written by Acres Gaming Incorporated, published prior to 2001.
Take Your Pick article written by Strictly Slots, published in Mar. 2001.
Top Dollar Game advertisement written by IGT, published in 1998.
Wheel of Fortune advertisement written by IGT, published in 1998.
Wheel of Fortune advertisement written by IGT, published in 1999.
Wheel of Fortune Slots S2000 Series advertisement, published in 2002.
Wheel of Fortune Video Slots advertisement on the website http://www.igt.com/games/new_games/wheel.html, printed Mar. 21, 2001.
Yahtzee Bonus advertisement written by Mikohn, published in 1999.

* cited by examiner

GAMING DEVICE HAVING A MECHANICAL SECONDARY DISPLAY

PRIORITY CLAIM

This application is a continuation-in-part of and claims the benefit of U.S. patent application Ser. No. 10/243,049, filed Sep. 12, 2002, now U.S. Pat. No. 7,247,093.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in Patent and Trademark Office patent file or records, but otherwise reserves all copyright rights whatsoever.

DESCRIPTION

The present invention relates in general to a gaming device, and more particularly to a wagering gaming device having a mechanical display which simultaneously reveals symbols or images to a player in an exciting and entertaining manner.

BACKGROUND OF THE INVENTION

Gaming device manufacturers strive to make wagering gaming devices that provide as much enjoyment, entertainment and excitement as possible to players. Providing interesting and exciting primary or base games and secondary or bonus games in which a player has an opportunity to win potentially large awards or credits is one way to enhance player enjoyment and excitement. Another way to enhance a player's enjoyment, entertainment and excitement with a gaming device is by including lights, sounds and other visual or audio or audio-visual effects in the gaming machines.

Some known gaming devices use mechanical devices such as reels or wheels to enhance the attraction of the machines to players and also to enhance the player's game playing experience. These mechanical devices enable a player to see physical movements of a game, a portion of a game, or a functional game event or element which increases the player's enjoyment of the game.

To increase player enjoyment and excitement, it is desirable to provide new and different mechanical devices in conjunction with wagering gaming devices.

SUMMARY OF THE INVENTION

One embodiment of the present invention includes a gaming device having a cabinet which supports a primary display. The primary display exhibits a primary wagering game to a player and the gaming device enables the player to play the primary wagering game displayed by the primary display. In one embodiment of the present invention, the gaming device enables a player to play a poker game such as a video draw poker game. A housing is connected to the top of the gaming device cabinet. In one embodiment, the housing supports an axle. A plurality of aligned mechanical members or display plates are suitably attached to the axle. The display plates are pivotally or rotatably connected to the axle in such a manner that in at least one position the display plates are horizontally aligned with each other. In this horizontal alignment position, the front display plate will block from the view of the player at least a portion of at least one of the display plates positioned behind it. An actuator or a plurality of actuators are coupled with the display plates to pivot or rotate the display plates to multiple positions such as horizontal or vertical positions. In one embodiment, the actuators cause the mechanical members to rotate in a manner such that each display plate may rotate independently of each other.

In one embodiment of the present invention, the display plates are horizontally aligned so that in an initial position the display plates in front block at least a portion of the display plates in the back from the view of a player. The gaming device's processor causes the actuators to rotate the display plates from the initial position so that the player is able to view the display plates behind the front display plates. Thus, the player initially viewing the mechanical display may only see the entire first or front display plate in the horizontal alignment. The processor causes the display plates to rotate to one or either side until a selected display plate can be seen.

It should be appreciated that in one embodiment the display plates are directly attached to the actuators which are supported by the housing. It should also be appreciated that other suitable mechanisms may be employed in accordance with the present invention.

The display plates may include images, symbols, awards, values or combinations thereof. In one embodiment of the present invention, each display plate includes a different image, symbol, award, value or combination thereof.

In one embodiment of the present invention, the display plates display gaming cards. The gaming cards are initially horizontally aligned with each other so that a player only sees the front card. Upon a triggering event in the primary poker game (as indicated above), the processor selects a gaming card to be displayed by the secondary display device and determines which display plate displays the selected gaming card. The processor causes the actuators to rotate the display plates having other gaming cards positioned in front of the display plate having the selected gaming card as well as that display plate so that the display plate having the selected card is revealed to the player. The player will see the cards rotating to either side or in some cases to one side until the selected card is displayed.

A player will feel a greater sense of anticipation and excitement from the present invention because the player will preferably be shown a number of images or symbols on other display plates before being shown the image or symbol selected by the gaming device. It should be appreciated that in one embodiment the displayed card can be used in conjunction with one or more of the video poker hands to the player by the display device. It should also be understood that the gaming cards displayed by the display plates may be used in poker games or other gaming devices as wild cards or additional or bonus cards given to or usable by the player during the course of the game.

In one embodiment of the present invention, the housing includes a non-viewable area. When the display plates move into a position in the non-viewable area, the images displayed by the display plates cannot be seen by the player. In one embodiment, the display plates remain in the non-viewable area until one or more of the images displayed by the display plates are selected by the processor. The processor causes the selected display plate(s) to move from the non-viewable area into a viewable area where plate(s) can be seen by the player. If more than one of the display plates are selected, the display plates are moved into a variety of positions so that each image displayed by each display plate can be seen by the player. In this manner, the player will see a plurality of images or values displayed by the display plates. Thus, it should be appreciated that symbols or images or multiple display plates may be provided or usable to the player in conjunction with a game such as a primary game or secondary game.

In one embodiment, the housing encloses the plurality of display plates. It should be appreciated that the housing may also display images preferably corresponding to the theme of the game played on the gaming device. It should also be appreciated that the housing may also support different display devices and/or indicators in addition the mechanical display plates.

In an alternative embodiment, the secondary mechanical display includes a secondary mechanical display including a housing connected to the top of the gaming device cabinet and at least one and preferably, a plurality of first and second display plates independently movably connected to the housing where the first and second display plates include first and second images such as first and second symbols, respectively. In one embodiment, the first and second display plates include first and second axes of rotation where the axes of rotation are different. In one embodiment, they are substantially parallel. Therefore, the first display plates move independently of and in generally in different directions from the second display plates. In one embodiment, the first display plates and the second display plates are adapted to simultaneously move toward and away from each other. In another embodiment, each of the first display plates and each of the second display plates are adapted to move toward and away from each other in a designated sequence or order. The first and second display plates may simultaneously move toward or away from each other, sequentially move toward and away from each other or move in any suitable predetermined or randomly determined order or sequence in a game.

In one embodiment, each of the first display plates and each of the second display plates include first axes of rotation and second axes of rotation which are different. In a further embodiment, at least two of the first axes of rotation are different from at least two of the second axes of rotation. The first and second display plates may include any suitable axes of rotation which enables the first and second display plates to move toward and away from each other.

In another embodiment, at least one of the first symbols and at least one of the second symbols are different. In a further embodiment, all of the first and second symbols are different. It should be appreciated that the first and second symbols may include awards, values, modifiers, free spins, free games, game elements or any suitable award, awards or outcomes.

In one embodiment, the first and second display plates include first and second actuators which independently move each of the first and second display plates relative to the housing. The first actuators are attached to the first display plates and the second actuators are attached to the second display plates. The gaming device causes the actuators to move which thereby moves the display plates. It should be appreciated that any suitable actuators or motors may be used to move each of the first and second display plates.

When a bonus game is triggered, the gaming device causes the first and second display plates to continuously, independently move toward and away from each other. The gaming device selects at least one of the first and second symbols to indicate to the player and then causes the display plates including the selected first and second images to move and indicate those symbols to the player in the game. The gaming device provides the player with an outcome such as an award based on at least one of the indicated first and/or second symbols on the first and second display plates.

In one embodiment, a control panel including several inputs is in communication with the secondary mechanical display. A first input controls the movement of the first display plates. A second input controls the movement of the second display plates. A third input controls the movement of both of the first and second display plates. A fourth input enables a player to accept or reject an outcome such as an indicated symbol or symbols in a game. If the player rejects an outcome displayed to the player by the first and second display plates, the player picks and activates one of the inputs described above to display another outcome based on the symbols indicated by at least one of the first display plates, at least one of the second display plates or by at least one of the first and second display plates.

In a further embodiment, the gaming device includes at least one Light Emitting Diode ("L.E.D.") attached to the housing, which is operable to direct light at one or more of the first and second display plates to better enable a player to view the first and second images on the first and second display plates. Any suitable lighting mechanism or illumination device may be used to illuminate the first and second display plates.

In another embodiment, a light display, including at least one substantially transparent panel and at least one light panel, is positioned behind the first and second display plates and connected to the housing. The substantially transparent panel is positioned adjacent to and in front of the light panel. In one embodiment, the light panel includes a plurality of L.E.D.'s which are attached to the light panel to form a picture or any other suitable image. In one embodiment, the transparent panel includes an opaque coating or tint which prevents a player from viewing the L.E.D.'s until the L.E.D.'s are illuminated in a game. Once the L.E.D.'s are illuminated, the picture or image formed by the L.E.D.'s becomes visible and viewable by a player in the game. In one embodiment, the L.E.D.'s are independently controlled by the processor to simultaneously or alternately illuminate one or more of the L.E.D.'s to create different visual effects. In another embodiment, the L.E.D.'s include one or more different color L.E.D.'s to enhance the visual effects in a game or games.

It should be appreciated that a triggering event which causes the actuation or activation of the mechanical display plates can occur in a primary game, a secondary game or a sub-game of a gaming device.

It is therefore an object of the present invention to provide a new and exciting display for wagering gaming devices.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
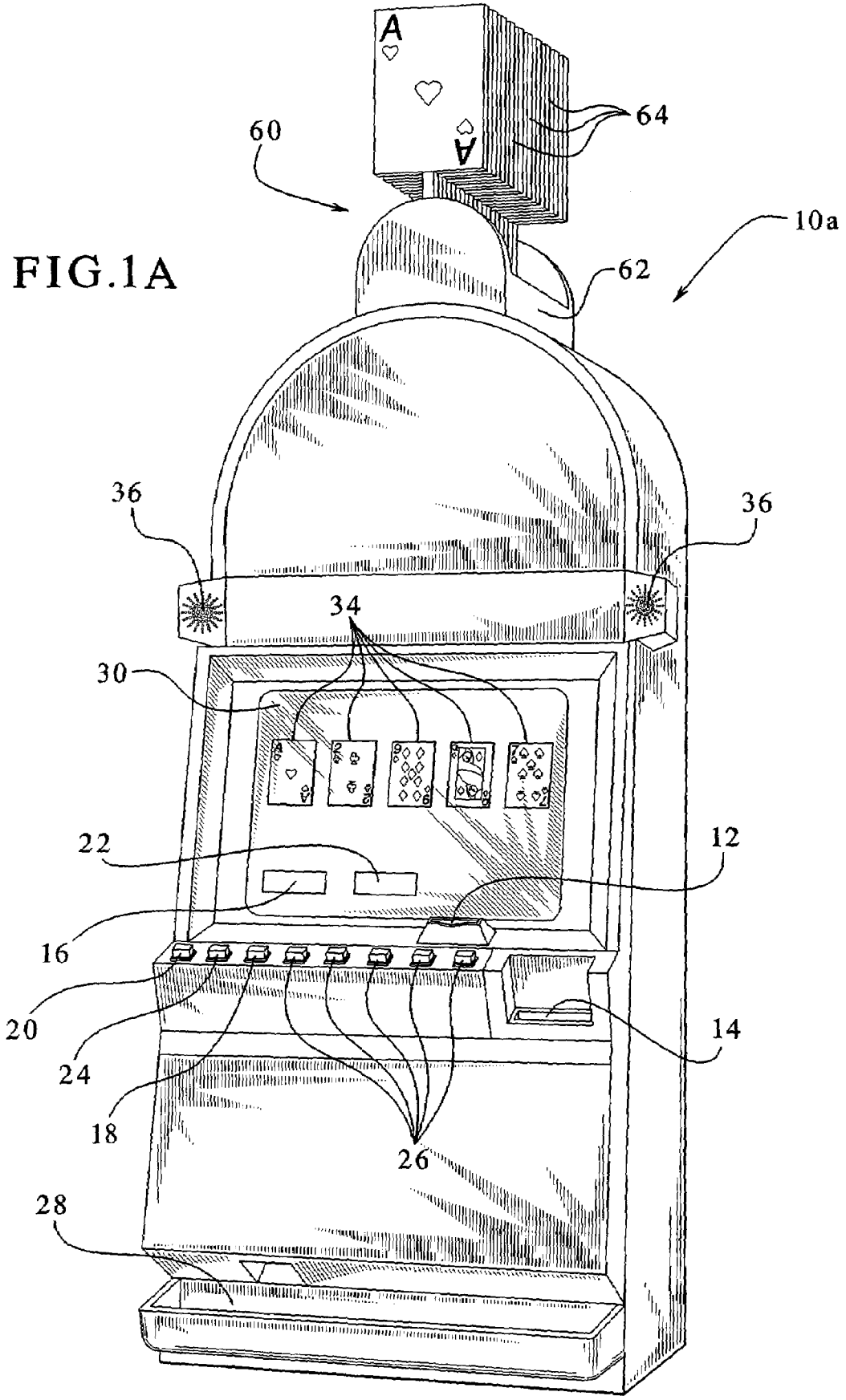
FIGS. 1A and 1B are front elevational views of general embodiments of the gaming device of the present invention.
Figure 1B:
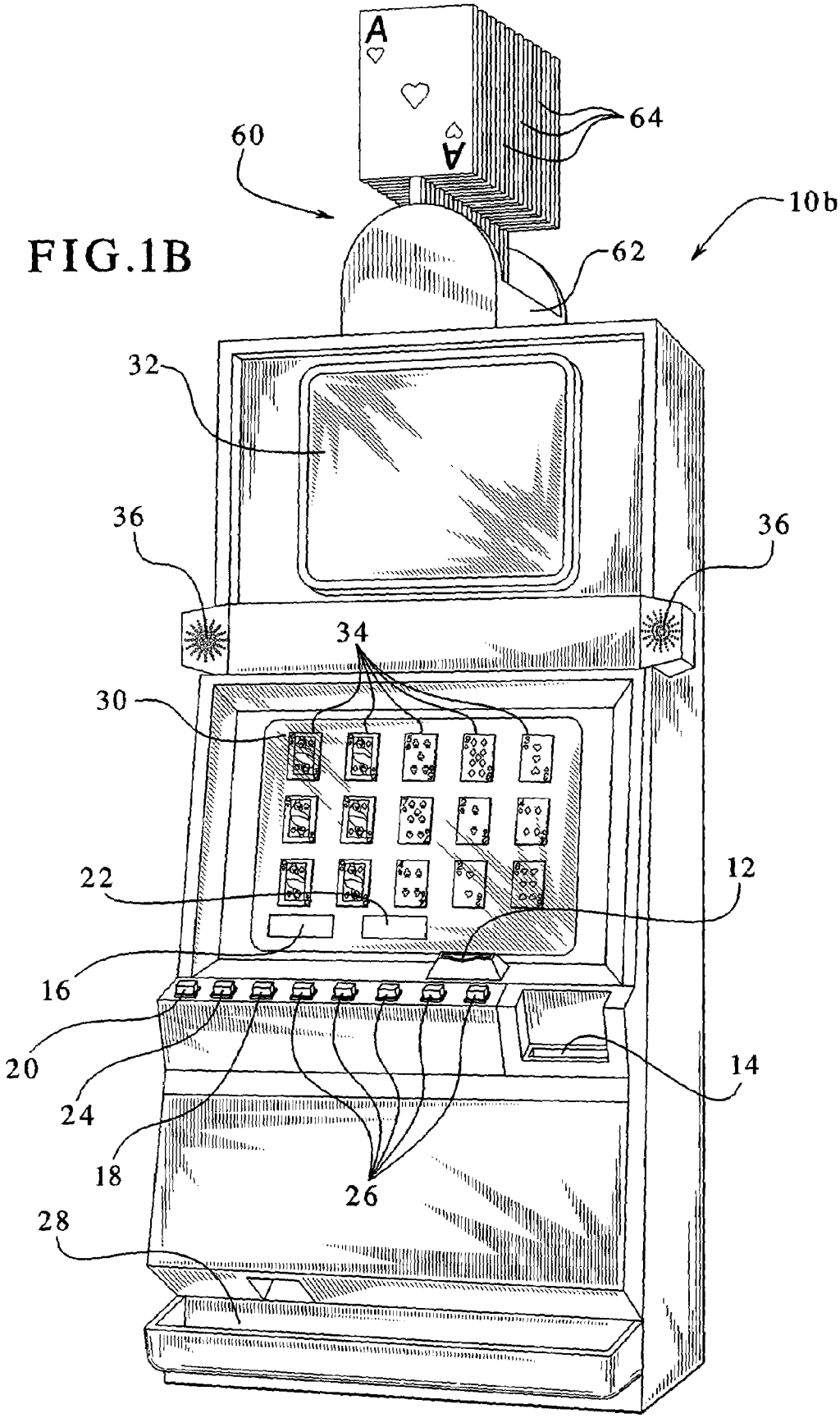

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 in one embodiment has the controls, displays and features of a conventional video poker machine. It is constructed so that a player can operate it while standing or sitting, and gaming device 10 is preferably mounted in a cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B.

Gaming device 10 can incorporate any primary game such as slot, poker, blackjack or keno, and any of the bonus triggering events and bonus games associated with these primary games. The symbols and indicia used on and in gaming device 10 may be in mechanical, electrical, electronic or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pushing a play or deal button 20. The play or deal button 20 can be any activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. Other bet or wager indicators such as a bet max button may also be employed in the gaming device of present invention.

A player may cash out and thereby receive a number of coins corresponding to the number of remaining credits by pushing a cash out button 18. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes a plurality of display devices. As shown in FIG. 1A, one embodiment includes a central display device 30 and also a mechanical display device 60. FIG. 1B includes a central display device 30 as well as an upper display device 32 and a mechanical display device 60. The gaming device 10 in one embodiment displays a plurality of cards 34 in video form by the central display device 30 and a plurality of cards 64 in mechanical form by the mechanical display device 60. The central display device can be any viewing surface such as glass, a video monitor or screen, a liquid crystal display, display plate or any other display mechanism. One preferred representation of the cards 34 is in video form wherein the preferred display device is a video monitor. The cards 64 are also preferably displayed in mechanical form and one preferred display device includes a plurality of display plates 64. The cards portray one or more decks of cards used in conventional poker games. The display plates may alternatively display a variety of images or symbols such as bells, hearts, fruits, numbers, letters or other images which may correspond to a theme associated with the gaming device. Furthermore, the gaming device 10 preferably illustrates speakers 36 for producing sound such as music.

Figure 2:
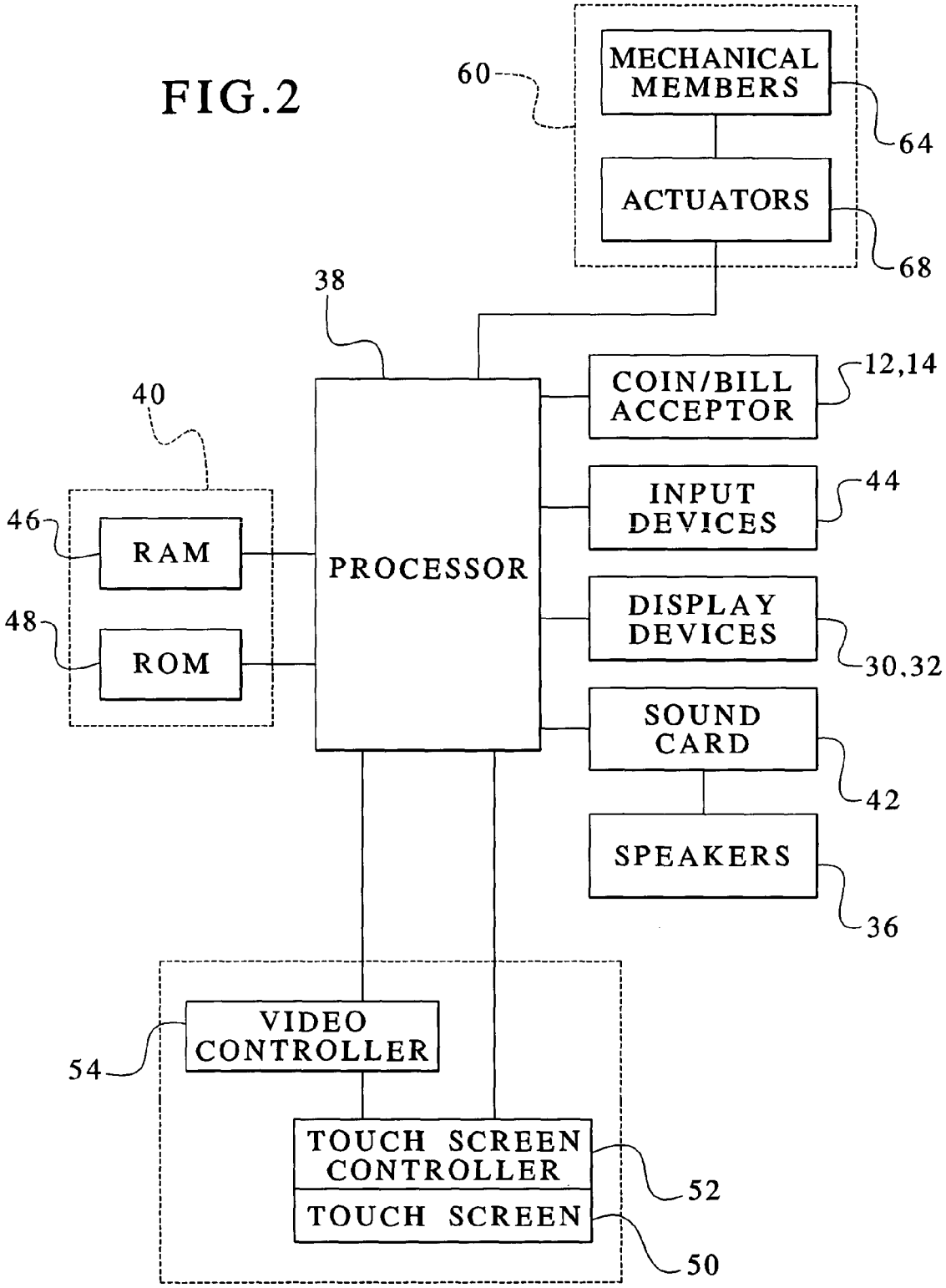
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a mechanical display device 60; a sound card 42; a plurality of speakers 36; and one or more input devices 44. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables. The memory device preferably stores program code which enables the gaming device to play a video poker game.

As illustrated in FIG. 2, the player preferably uses the input devices 44, such as the deal button 20, the bet one button 24, the hold cards buttons 24 and the cash out button 18 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively or alternatively referred to herein as a "processor"). Furthermore, although the processor 38 and memory device 40 preferably reside on each gaming device 10 unit, it is possible to provide some or all of their functions at a central location such as a network server for communication to a playing station such as over a data network such as a local area network (LAN), wide area network (WAN), Internet connection, microwave link, and the like. The processor 38 and memory device 40 are generally referred to herein as the "computer" or "controller."

With reference to FIGS. 1A, 1B and 2, to operate the gaming device 10, in one embodiment the player must insert the appropriate amount of money or tokens at coin slot 12 or bill acceptor 14 and then push the deal button 20. In one embodiment, the processor 38 enables the player to play a conventional game of video poker. In another embodiment, the controller enables a player to play a multi-hand version of video poker. In one embodiment, in either a bonus scheme or the primary game, the mechanical display 60 is used to display a gaming card 64 used in the primary or bonus game. In one embodiment, the mechanical display 60 is used to display the award(s) or value(s) which are provided to the player.

The Mechanical Display Device

Figure 3:
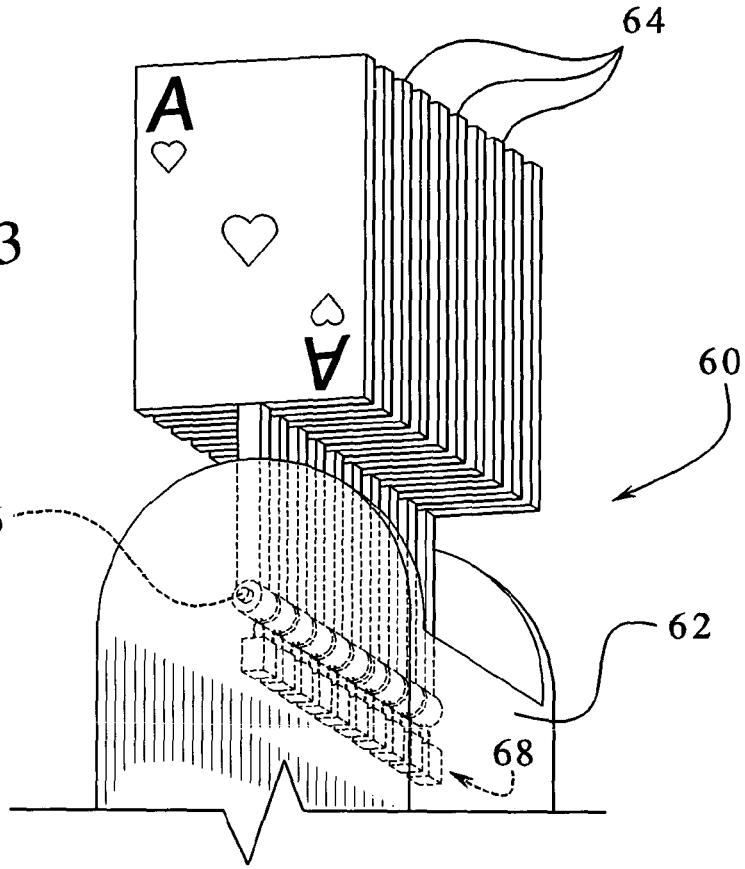
FIG. 3 is a front perspective view of the display device illustrating one embodiment of the present invention.
Figure 4:
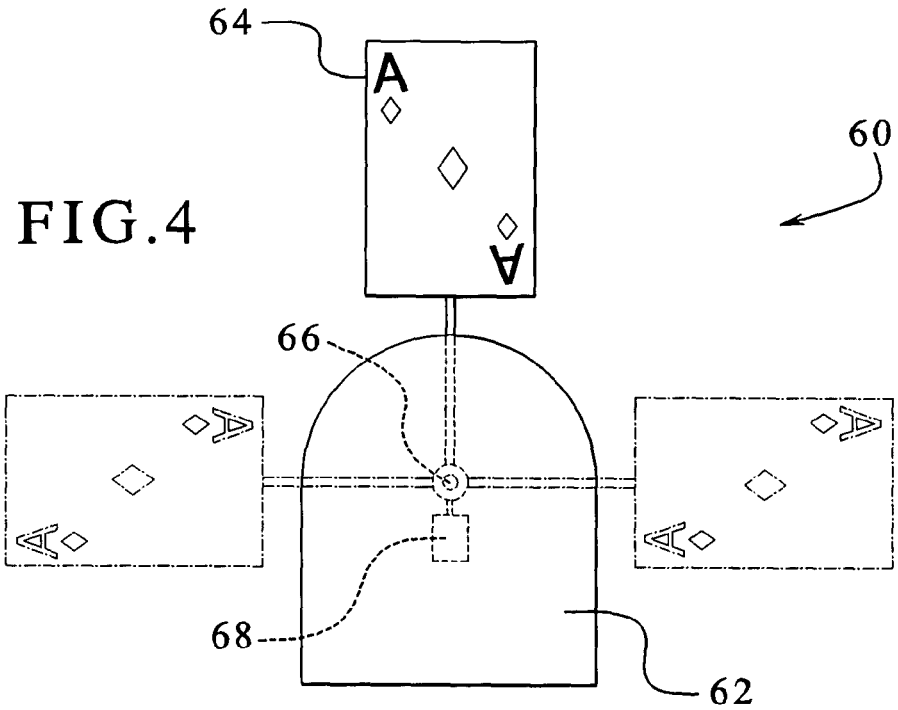
FIG. 4 is a front elevational view of the display device illustrating one embodiment of the present invention, wherein the display plates pivot about the axle.

In one embodiment of the present invention, the gaming device 10 includes a primary display 30, and a secondary mechanical display 60 as illustrated in FIGS. 1A and 1B. The secondary mechanical display is preferably connected to the top of the gaming device cabinet. The secondary mechanical display includes a housing 62 which supports an axle 66 along which a number of display plates 64 are suitably connected as shown in FIG. 3. In this embodiment, each display plate 64 is pivotally or rotatably connected to the axle 66 so that each display plate 64 may move to a horizontal, vertical or other suitable position as shown in FIG. 4.

Figure 5:
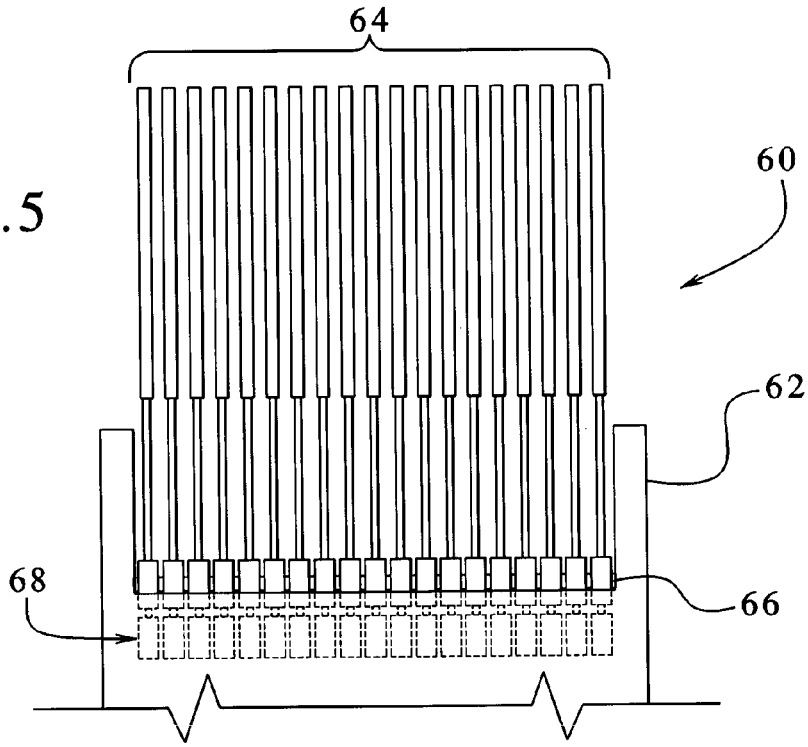
FIG. 5. is a side elevational view of the display device illustrating one embodiment of the present invention.

The display plates 64 in at least one position are horizontally aligned with each other as shown in FIG. 3 and in FIG. 5. Thus, in at least one position, a player will only see the entire image displayed by the front most display plate 64 as shown in FIG. 3. The front most display plate at least partially blocks from the view of the player the display plates which are behind the front most display plate.

Figure 6:
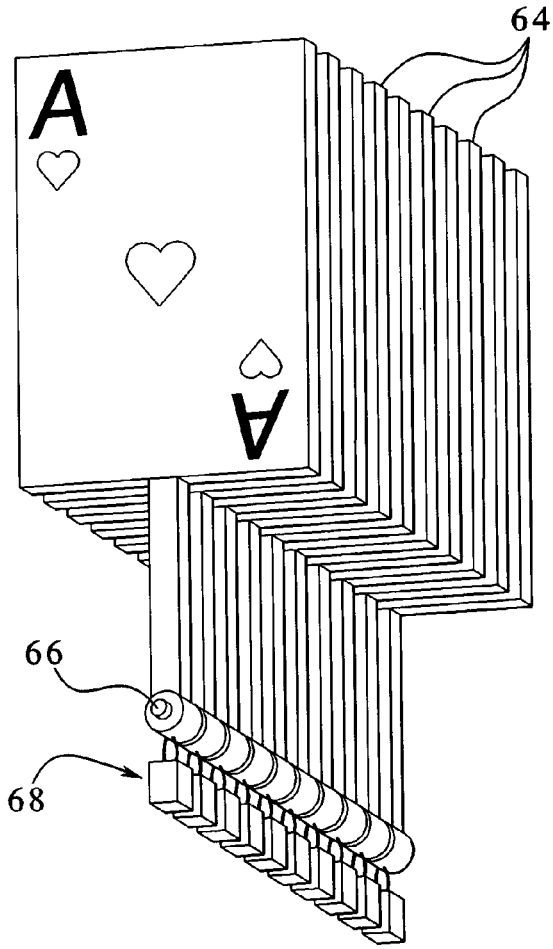
FIG. 6 is a front perspective view of a plurality of display plates in one embodiment of the present invention where the display plates are connected to an actuator.

In one embodiment of the present invention, at least one actuator 68 is connected to or coupled with each of the display plates 64 as shown in FIG. 6. In another embodiment of the present invention, the display plates 64 may be connected directly to the actuators 68 and are not connected to an axle. Such actuators 68 may in one embodiment be supported by the housing. It should be appreciated that the actuator may be any suitable device which causes the display plates to rotate such as a solenoid, a motor, a stepper motor, a biasing device (such as a spring or weighted means) or a combination of these devices.

Figure 7:
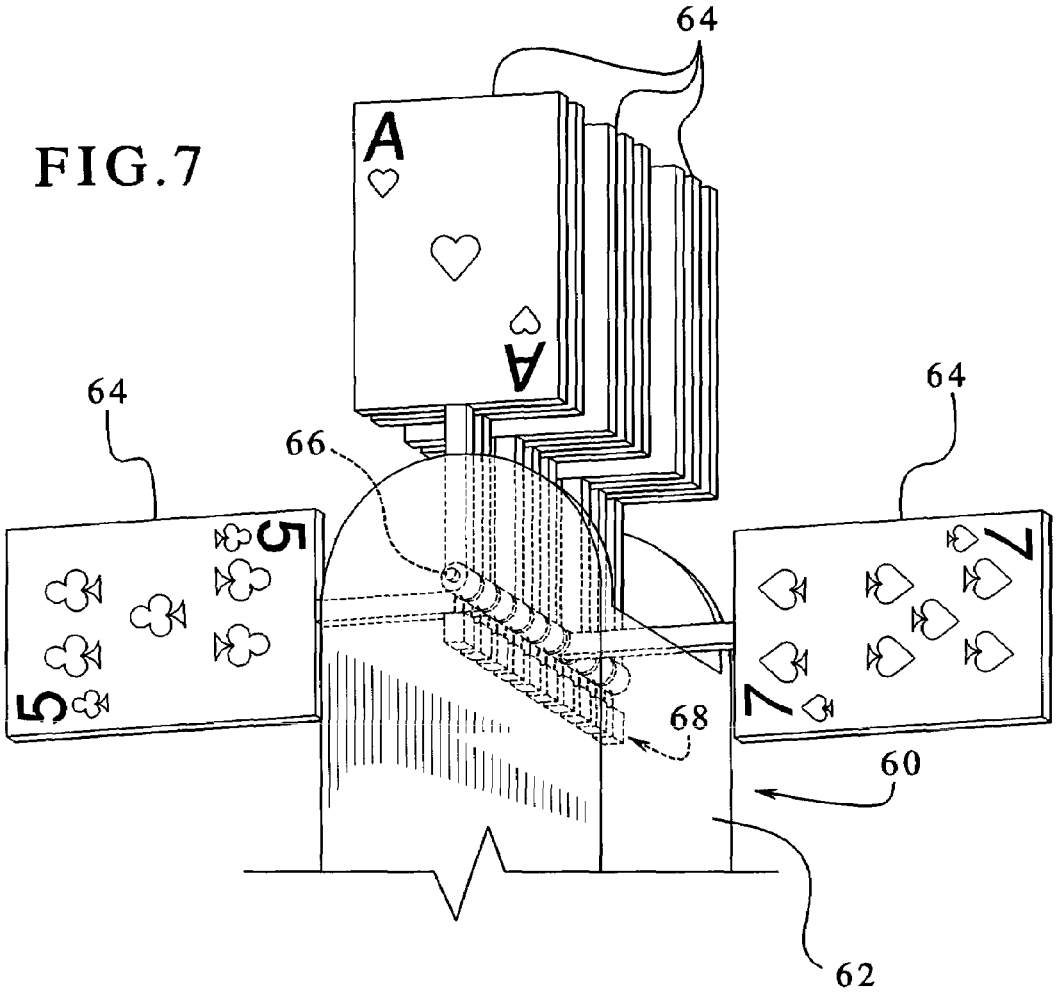
FIG. 7. is a front perspective view of the display device illustrating another embodiment of the present invention, wherein a number of display plates pivot independently.

The actuators 68 cause the display plates 64 to rotate independently of each other as shown in FIG. 7. Each display plate 64 may move to any suitable position, horizontal, vertical or at a non-horizontal or vertical angle, irrespective of the positions of the other display plates 64. Since each of the display plates 64 may also move independently of the other display plates 64, multiple display plates could be moving in different directions and at different rates and at different times.

Figure 8:
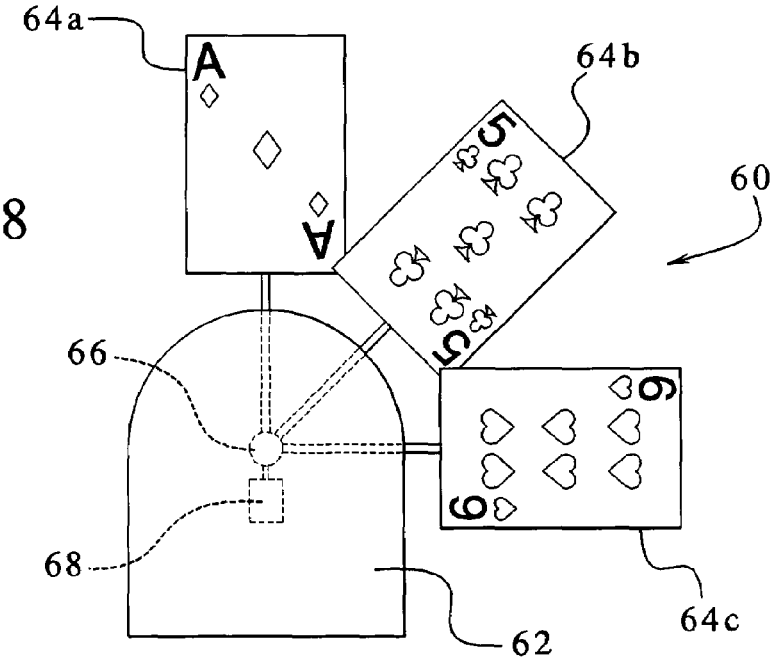
FIG. 8 is a front elevational view of the display device illustrating another embodiment of the present invention, wherein a plurality of display plates have moved to reveal a selected image.

In one embodiment of the present invention, the processor 38 is in communication with the primary display 30 which displays a game and following a triggering event in the game, the processor 38 selects an image associated with one of the display plates 64 to be displayed. The processor 38 then determines which of the display plates 64 displays the selected image. The processor 38 causes the display plates 64 in front of the display plate 64 displaying the selected image to rotate and reveal that display plate 64 displaying the selected image as shown. In FIG. 8, the display plate including the Six of Hearts 64*c* and the display plate including the Five of Clubs 64*b* move to reveal the selected display plate which includes the Ace of Diamonds 64*a*. In an alternative embodiment, the display plate having the selected image could also move. In a further alternative embodiment, all of the displays plates can move. In such embodiment, the selected display plate will ultimately stop in a position viewable by the player and indicated to be the selected display plate. In one alternative embodiment, the display plate having the selected image moves out of alignment with the other display plates.

In one embodiment of the present invention, the images displayed by the display plates are cards used in a conventional poker game. It should be appreciated that the present invention can be used in other card games or in other types of games. The processor enables a player to play a video poker game or some other card game using at least one display and upon a triggering event in the video card game, the processor selects one of the cards to be displayed by the mechanical display. The processor then determines which display plate displays the selected card and causes the display plates in front of the selected symbol to move in order to reveal the selected card to a player.

It should be appreciated that the cards displayed by the mechanical display could be used in a variety of ways, such as wild cards, or additional cards given to the player during the course of the card game.

Figure 9:
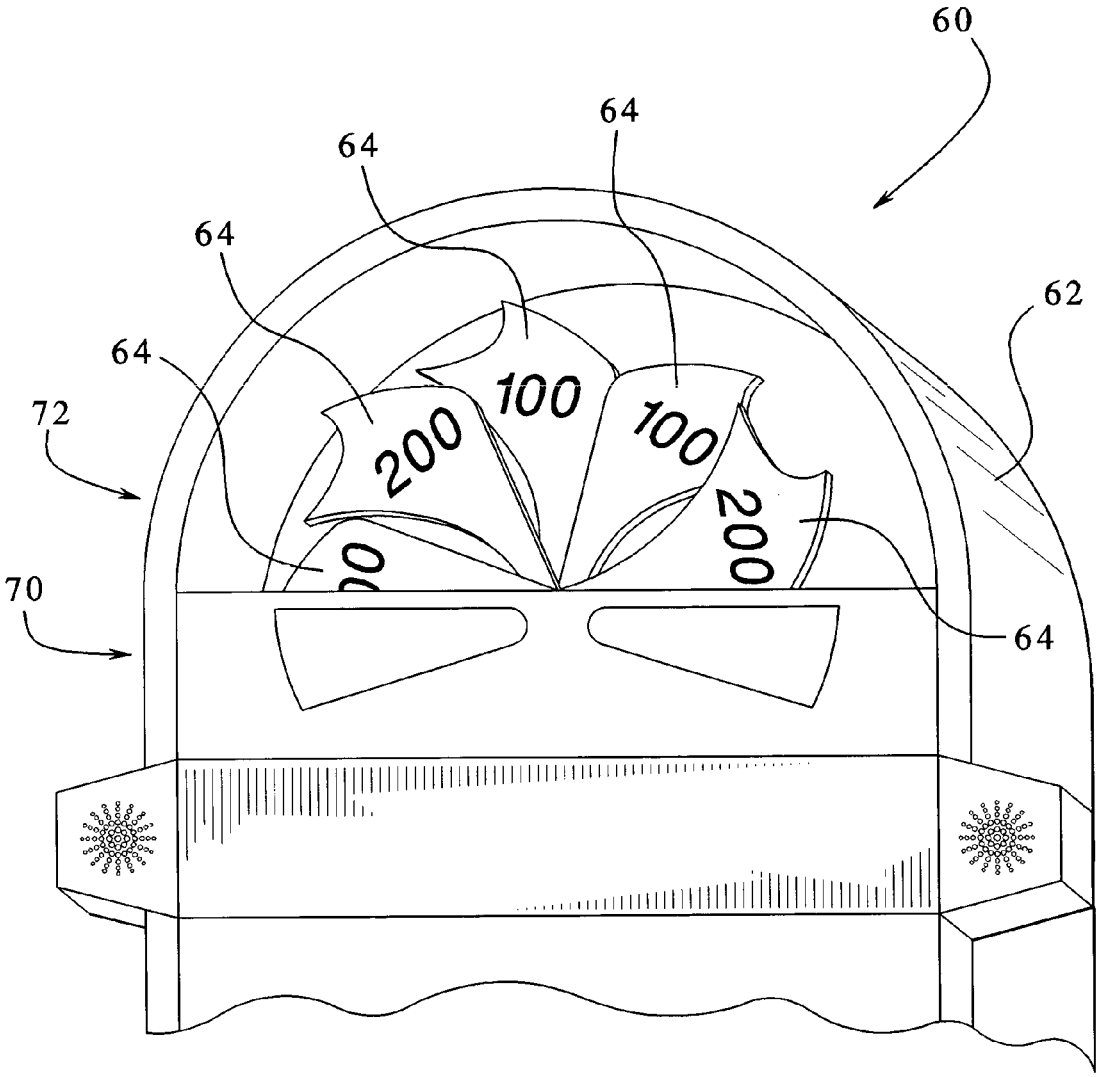
FIG. 9 is a front elevational view of the display device illustrating another embodiment of the present invention, wherein the plurality of images displayed by the display plates include symbols and values.

In one embodiment of the present invention, the display plates 64 display images other than conventional gaming card symbols. The images displayed by the display plates include a plurality of value symbol as illustrated in FIG. 9. The housing 60 encloses the display plates 64 and the housing 60 itself displays images or symbols relating to the theme of the game played on the gaming device. The gaming device in this embodiment includes a non-viewable area 70, wherein the images displayed by the display plates 64, which are in a position in the non-viewable area 70, are hidden from the view of the player. In one embodiment, the processor 38 causes the display plates 64 to remain hidden from the view of the player until one or more of the images displayed by the display plates 64 are selected. The processor causes the display plate or plates 64 displaying the selected image or images to move into an area 72 where the player can view the selected image(s). As illustrated by FIG. 9, the player can view a plurality of value symbols. The display plates 64 are in a plurality of positions where the player can view the selected images simultaneously. In this manner the player will feel excitement and anticipation as one or more of the value symbols displayed by the display plates 64 may be awarded to the player.

In one embodiment of the present invention, the display plates are in initial positions wherein a player can view the images displayed by each display plate. The processor selects the image(s) to be displayed to the player and causes the display plates displaying the non-selected images to move into a position in the non-viewable area, so that the only images the player sees are the images selected by the processor.

Referring to FIGS. 10, 11, 12, 13, 14A and 14B, an alternative embodiment of the present invention is illustrated where the gaming device 10 includes a primary display 30 and a secondary mechanical display 100. The secondary mechanical display includes a plurality of display mechanisms 108 each being operable to move at least one display plate 112. In one embodiment, upon a triggering event in a game, the display mechanisms 108 on the left side of the housing move the display plates 112 toward and away from the opposing display mechanisms on the right side of the housing. Similarly, the display mechanisms on the right side of the housing move the display plates toward and away from the display mechanisms on the left side of the housing. Therefore, both sets of the display plates of the display mechanisms are independently moving back and forth. In this embodiment, the gaming device selects at least one of the images or symbols on the display plates and causes one of the display plates to display or indicate the selected symbol to a player. In one embodiment, an opaque panel 106 is connected to the housing to substantially prevent a player from viewing the display plates which do not include the selected symbol or symbols. It should be appreciated that the display mechanisms may move the display plates in any suitable order or sequence.

In one embodiment, the secondary mechanical display 100 includes a housing 101, a frame 105 connected to the housing and a plurality of display mechanisms 108 which are connected to the frame 105. In one embodiment, the frame 105 includes a bottom panel 107*e*, two side panels 107*c* and 107*d* suitably connected to the bottom panel 107*e*, a front panel 107*a* connected to the bottom panel and to the two side panels and a rear panel 107*b* connected to the bottom panel and the two side panels. In one embodiment, the frame 105 is manufactured using metal. It should be appreciated that the frame 105 may be manufactured using any suitable material such as a suitable metal. The frame 105 is connected to the lower portion of the housing 101 using suitable connectors such as screws or other suitable connecting devices. Similarly, the housing 101 encloses the display mechanisms and is connected to the top of the cabinet of the gaming device 10 using any suitable connectors or connecting devices. In another embodiment, the housing 101 is separate from the gaming device and positioned in any suitable location in relation to the gaming device. It should be appreciated that the housing may be a glass housing or any other suitable cover.

Figure 12:
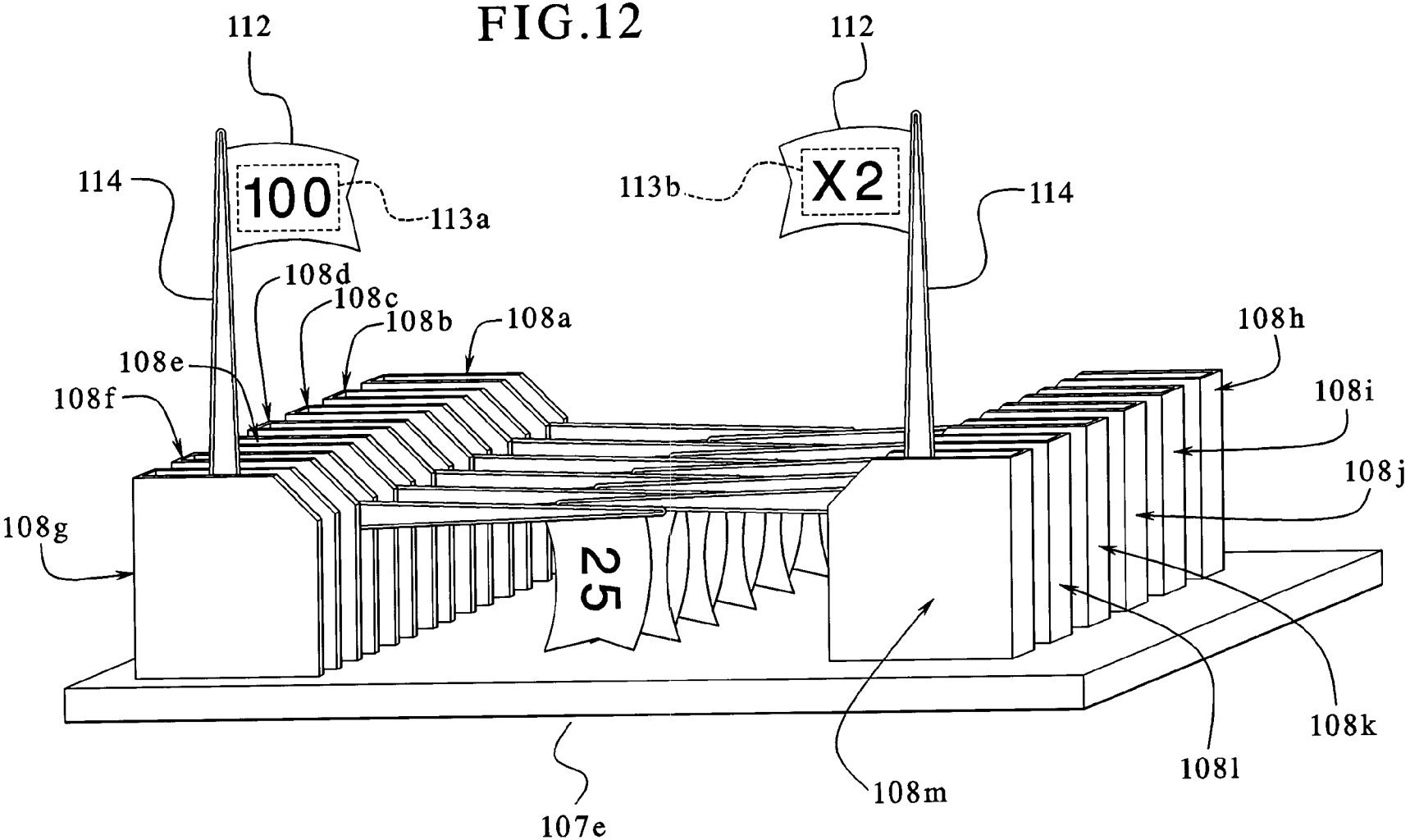
FIG. 12 is a front perspective view of the mechanical display device of FIG. 11 without the housing.
Figure 13:
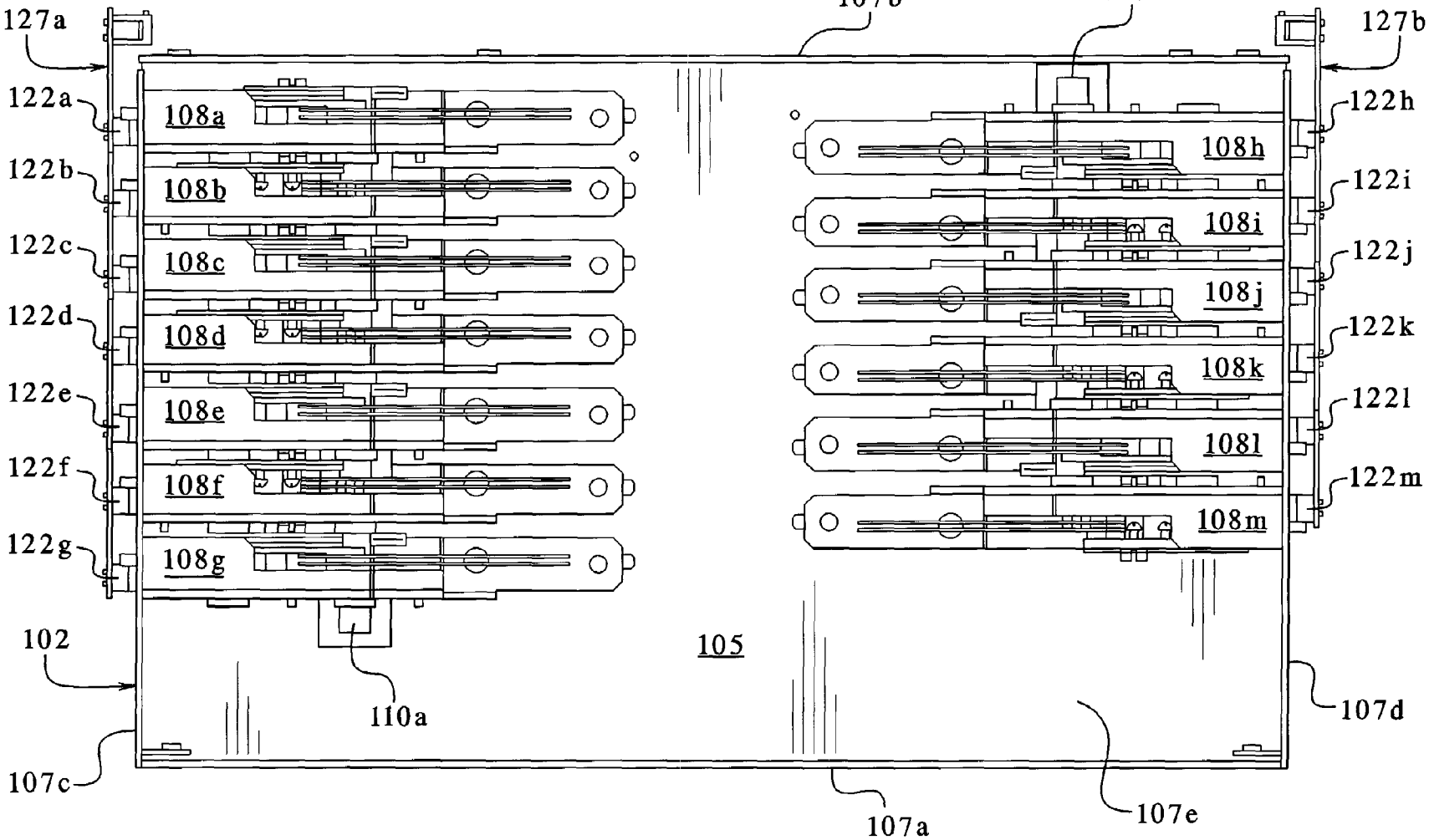
FIG. 13 is a top view of the embodiment of FIG. 12.

In one embodiment, the secondary mechanical display 100 includes thirteen display mechanisms 108 including thirteen display plates 112 as shown in FIGS. 12 and 13. It should be appreciated that any suitable number of display mechanisms may be employed in a game. In one embodiment, a plurality of first display mechanisms 108*a* to 108*g* are positioned on and secured to the left side of the frame 105 as a player views the frame 105 from the front of the gaming device. Similarly, a plurality of second display mechanisms 108*h* to 108*m* are positioned adjacent to and opposing the first display mechanisms 108*a* to 108*g* and are secured on the right side of the frame 105 as a player views the frame from the front of the gaming device.

In this embodiment, the first display mechanisms 108*a* to 108*g* include a first axis of rotation and the second display mechanisms 108*h* to 108*m* include a second axis of rotation, where the first and second axes of rotation are different. In another embodiment, the first display mechanisms 108*a* to 108*g* and the second display mechanisms 108*h* to 108*m* are each associated with an axis of rotation. In this embodiment, at least two of the axes of rotation associated with first display mechanisms 108*a* to 108*g* and at least two of the axes of rotation associated with second display mechanisms 108*h* to 108*m* are different. It should be appreciated that one, a plurality of or all of the axes of rotation associated with the display mechanisms may be different.

In one embodiment, the first and second display mechanisms 108 are staggered or alternatively positioned so that the second display plates 112*h* to 112*m* are positioned between the first display plates 112*a* to 112*g* when the first and second display plates are in the down position or positioned closest to the bottom panel 107*e* of the frame 105. In this embodiment, each display plate 112 overlaps an adjacent display plate or obscures at least a portion of the adjacent display plate. In another embodiment, the first and second display mechanisms are positioned on the left and right sides of the frame 105 and are spaced sufficiently apart so that the first and second display plates of the first and second display mechanisms do not overlap or obscure each other. It should be appreciated that the display mechanisms may be placed and secured in any suitable positions or areas on the frame 105.

In one embodiment, the display mechanisms 108 each include a display housing 116, a display member 117 movably connected to the display housing, and a drive mechanism 118, which is adapted to control the movement of the display member 117. In one embodiment, the display housing 116 includes a base support or base 119 which is positioned and connected to the frame 105. In one embodiment, the base 119 is integrally formed with the frame 105. In another embodiment, the base 119 is connected or otherwise attached to the frame 105 using suitable connectors such as screws or other suitable connecting devices. In one embodiment, the base 119 includes alignment pins 136*a*, 136*b* and 136*c*, which align with corresponding receptacles (not shown) in the frame 105 to position and secure the base 119 to the bottom panel 107*e* of the frame 105. In addition, alignment pins 136*d* and 136*e* position and align the display housing 116 with corresponding receptacles (not shown) formed on one of the side panels 107*a* or 107*b* depending on which side of the housing 101 the display mechanisms are positioned. The display housing 116 thereby maintains the position of each display mechanisms in the housing so that the display mechanisms do not move out of position during a game.

In one embodiment, the display mechanisms 108 each include at least one display member 117, which is independently movably connected to the display housing 116. Each of the display members 117 includes a display plate 112 and a plate support 114. In one embodiment, the display plate 112 includes an image or symbol such as a value, a modifier, a prize, a game element such as a playing card, or any other suitable image. In one embodiment, at least two of the symbols on the display plates are different. In another embodiment, all of the symbols on the display plates are different. As shown in drawings, in one embodiment, the display plates are flag-shaped and correspond to a theme associated with the gaming device. It should be appreciated that the display plates may be any suitable shape and correspond to any suitable theme or themes associated with the gaming device.

In one embodiment, the display plate 112 is connected to one end of the plate support 114 using suitable connectors or connecting devices. In another embodiment, the display plate 112 is integrally formed with the end of the plate support 114. The plate support 114 is a generally elongated tube-like member which supports the display plate 112. An opposite end of the plate support 114 is connected to the drive mechanism 118.

In one embodiment, the drive mechanism 118 is adapted to move the plate support 114 to one of several different positions, which simultaneously moves the display plate 112 to the same positions. In this embodiment, the drive mechanism includes an actuator 110, a drive shaft 126 movably connected to the actuator, a control shaft 124 and a drive belt 128 which couples the drive shaft with the control shaft. In one embodiment, the control shaft 124 is rotatably connected to the display housing 116 and includes a control member 121 which is connected to one end of the display support 114. The control shaft 124 also includes a flange member 123 which is generally cylindrically shaped and has a smaller diameter than the diameter of the control member 121. The flange member 123 projects generally transversely from the surface of the control member 121 and includes a small groove or similar channel (not shown). The groove is adapted to receive one end of the coupling member 128 to maintain frictional contact between the coupling member and the flange member. In one embodiment, the control shaft 124 defines a center opening 125 which aligns with a corresponding opening defined in the display housing 116. The opening is formed to receive a corresponding connector such as a screw 130, which rotatably connects the control shaft 124 to the display housing 116.

In one embodiment, the drive shaft 126 is rotatably coupled to an actuator such as a suitable motor 110, which is connected to the display housing 116 using a suitable motor mount or motor bracket 111. The motor mount or motor bracket 111 is connected to the display housing 116 using suitable connectors. In one embodiment, the drive shaft 126 defines an opening for receiving a rotating member such as axle 133. In one embodiment, one end of the axle 133 is inserted and secured to the motor 110. The second end of the axle is inserted into and secured in the opening defined by the drive shaft 126. It should be appreciated that the axle 133 may be integrally formed with the drive shaft, connected to the drive shaft or secured to the drive shaft using any suitable connectors or connecting methods. In one embodiment, a processor or similar control causes the motor to rotate the axle 133 which in turn, causes the drive shaft 126 to simultaneously move or rotate to one or more designated positions. In one embodiment, the drive shaft 126 includes a groove or similar channel (not shown) formed in the outer surface of the drive shaft for receiving the drive belt 128.

Figure 14A:
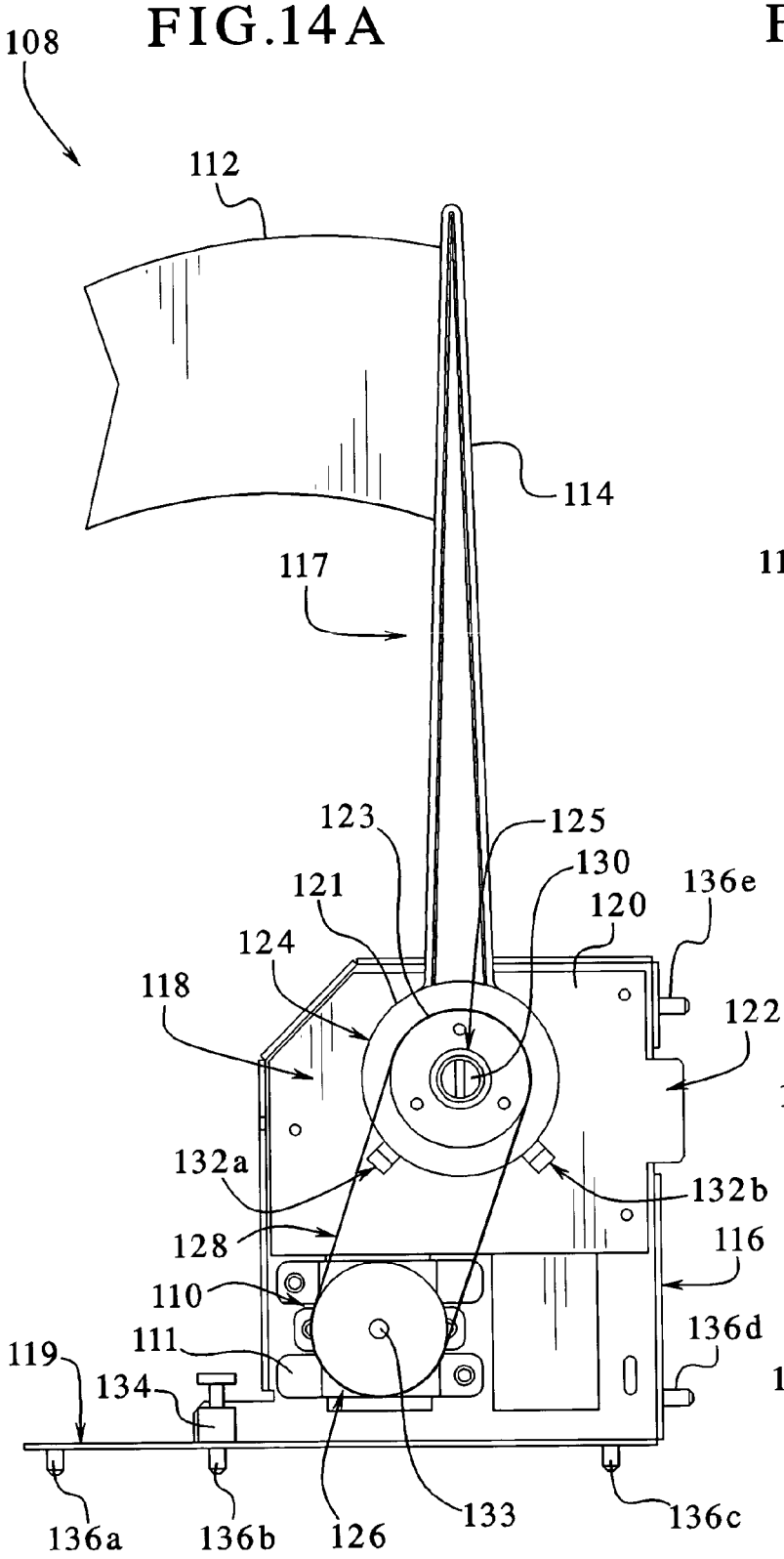
FIG. 14A is a front view of one embodiment of a display mechanism of the present invention.
Figure 14B:
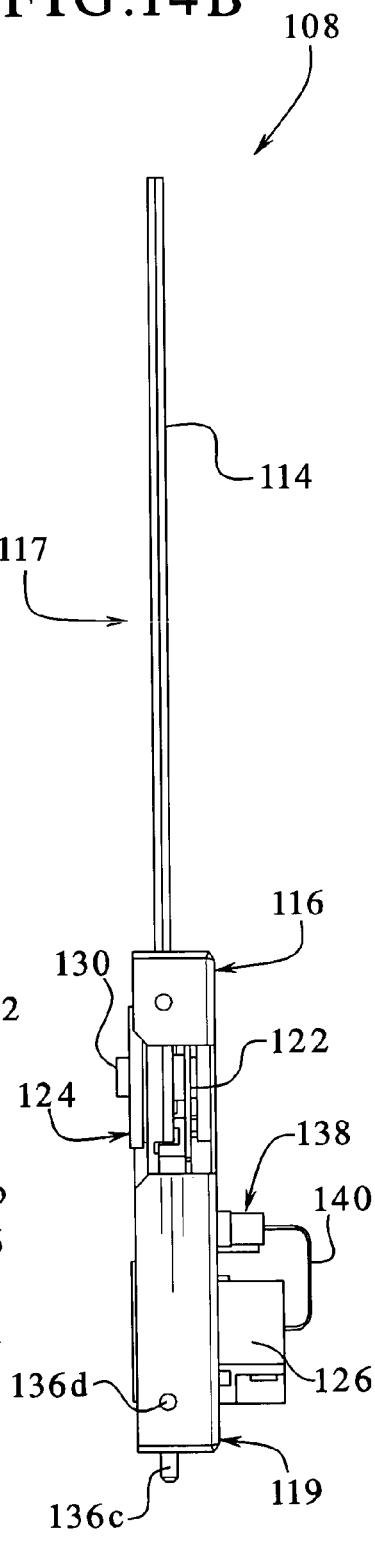
FIG. 14B is a side view of the embodiment of FIG. 14A.

In one embodiment, the drive belt or band 128 is positioned on and frictionally engages the grooves or channels formed in the outer surfaces of the flange member 123 and the drive shaft 126 as shown in FIG. 14A. The drive belt 128 is manufactured using a suitable material such as a durable rubber which stretches about both of the flange member and the drive shaft. It should be appreciated that the drive belt may be manufactured using any suitable material and may be any suitable size or shape. The drive belt 128 couples the drive shaft 126 to the control shaft 124 so that the control shaft 124 moves simultaneously with the movement of the drive shaft 126. In one embodiment, the motor 110 rotates the drive shaft 126 which simultaneously causes the drive belt 128 and the control shaft 124 to rotate. It should be appreciated that the motor 110 may be a stepper motor or any other suitable motor and may intermittently or continuously rotate the drive shaft 126 to control the movement of the display plates 112.

In one embodiment, position sensors 132*a* and 132*b* or other suitable sensing devices are attached to the control member 121 of the control shaft 124 to sense and determine the radial position of the control shaft 124 at a designated point or points in time during operation. The position sensors 132*a* and 132*b* are adapted to communicate the determined position of the control shaft 124 and thereby the position of the display plate 112 to the processor which controls the movement of the display plate 112.

In one embodiment, the display mechanisms 108 each include a circuit board 120 having an interface card 122 which is connected to main control boards or main circuit boards such as the main control board 127*a* on the left side of the frame as one views the front of the gaming device and main control board 127*b* on the right side of the frame. The main control boards 127*a* and 127*b* are adapted to facilitate communication between the position sensors 132*a* and 132*b* and the processor connected to each of the display mechanisms. In one embodiment, the interface card 122 slides into or inserts into the main control board 127*a* or 127*b* by engaging a corresponding slot (not shown) on the circuit board. Additionally, a pin 134 or other suitable connector is inserted into a receptacle on the base 119 to secure the base and the display housing 116 to the bottom panel 107*e* of the frame 105 to prevent the interface card 122 from moving and separating from the main control boards 127*a* and 127*b*.

In one embodiment, the display mechanism 108 moves the display plate 112 to one of several positions to display an image or symbol on the display plate to a player in a game. In particular, the processor communicates with the display mechanism 108 by transferring electrical signals from the processor to the motors 110 of one or more of the display mechanisms 108 via suitable wiring, the circuit board or control boards 127*a* and 127*b*, and the corresponding interface cards 122 associated with each of the display mechanisms. The interface card 122 and circuit board 120 are adapted to receive the electrical signals from the processor and communicate these signals to the motor 110 to activate the motor.

Once activated, the motor 110 simultaneously rotates the drive shaft 126, drive belt 128 and control shaft 124 to a desired radial position or positions relative to the frame 105. Correspondingly, the control shaft 124 rotates the plate support 114 which simultaneously moves the display plate 112 to the desired position. The position sensors 132*a* and 132*b* sense or track the radial position of the control shaft 124. Therefore, when the desired position of the display plate 112 is achieved, the position sensors 132*a* and 132*b* communicate with the processor via the wiring, interface card 122 and the corresponding main control board 127*a* or 127*b* to de-activate the motor 110 and stop the movement of the shaft and corresponding display plate at the desired position.

In one embodiment, each motor 110 includes a motor connector 138 and a motor cable 140. The motor cable 140 is connected to the motor 110 at one end and the motor connector 138 at the other end. The motor connectors are each connected to the interface cards 122. Therefore, the motor connectors and the motor cables enable the processor to communicate with each of the motors 110 via each of the interface cards 122. In one embodiment, each motor 110 is a separate motor which is independently controlled by the processor. The processor causes the motors to move the display plates independently so that each of the display plates, a plurality of the display plates are all of the display plates may move simultaneously or intermittently to the same position or positions or to several different positions.

In one embodiment, a plurality of inputs 102 are in communication with the display mechanism 108 and enable a player to pick which set of display mechanisms the player wants to operate in a game such as a bonus game. In one embodiment, input 102*a* controls the left set of display mechanisms 108 (as a player views the housing from the front of the gaming device) and causes the movement of one or more of these display mechanisms when the player presses or otherwise activates this input. Input 102*b* enables a player to pick and activate at least one of the display mechanisms 108 in each of the left and right sets of display mechanisms 108. Input 102*c* enables a player to pick and activate at least one of the display mechanisms 108 on the right side of the housing as a player views the housing from the front of the gaming device. In addition, input 102*d* enables the player to accept or reject a symbol or combination of symbols indicated by one or more of the display mechanisms displayed to the player by the gaming device. In one embodiment, a prompt display or prompt 104 indicates instructions such as an action to be taken by the player in the game or displays any other suitable message to the player. The prompt may be any suitable type of display such as a video display or other display device.

Figure 15A:
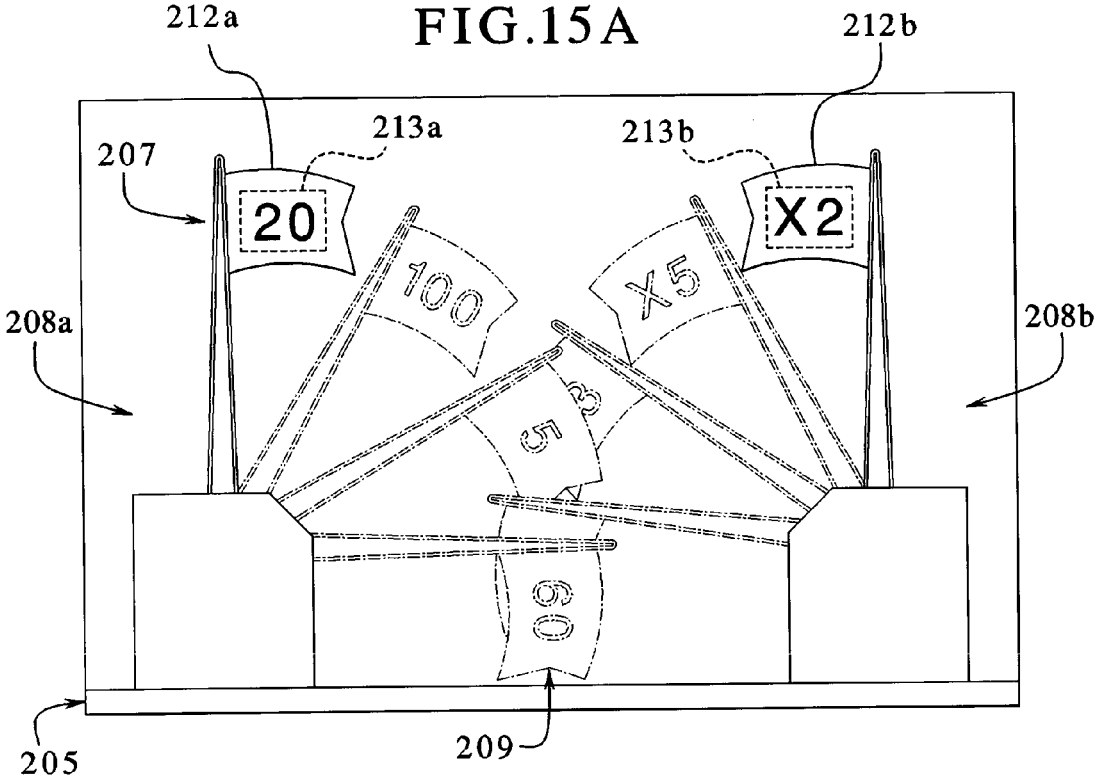
FIG. 15A is a front view of the alternative embodiment of the present invention where the display plates sequentially move to indicate the symbols included on the display plates to a player.
Figure 15B:
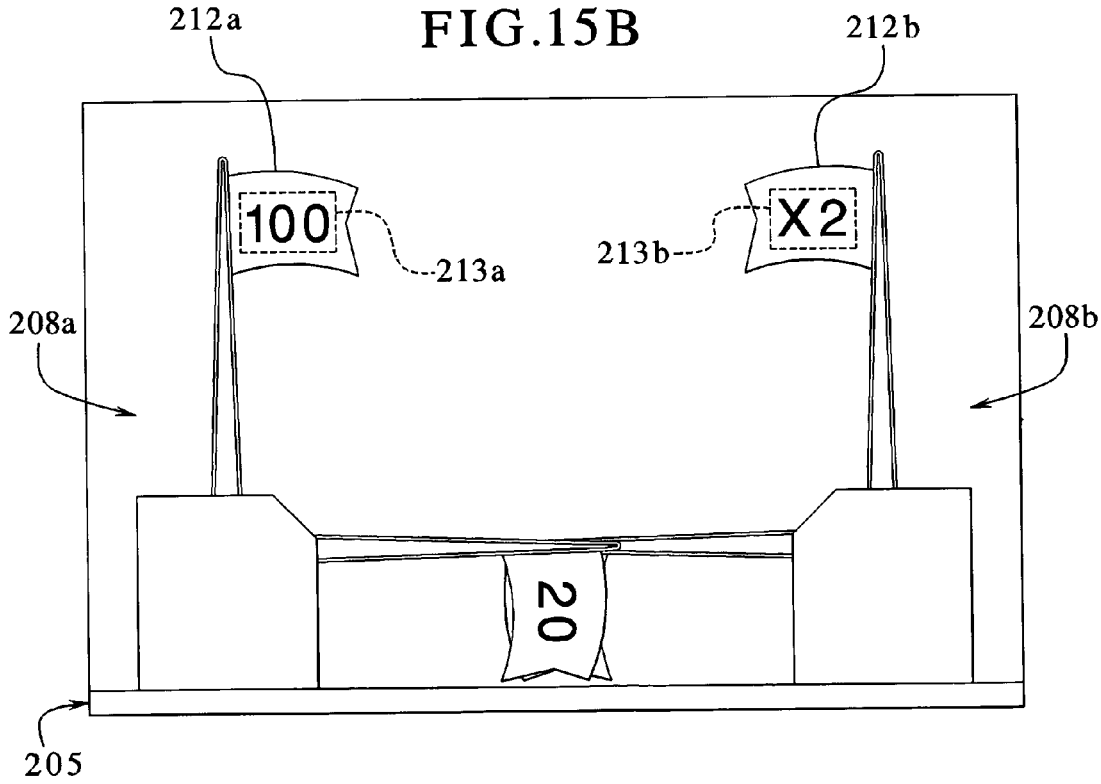
FIG. 15B is a front view of the alternative embodiment of the present invention illustrated in FIG. 15A where two symbols are indicated by the display plates.

Referring now to FIGS. 15A and 15B, one alternative embodiment of the secondary mechanical display of the present invention is illustrated where the secondary mechanical display includes a frame 205 and a plurality of first display mechanisms 208*a* including a plurality of first display plates 212*a* and a plurality of second display mechanisms 208*b* including a plurality of second display plates 212*b*. In this embodiment, the first display mechanisms 208*a* are positioned and secured to one side of the frame and the second display mechanisms 208*b* are positioned and secured to the opposite side of the frame. The first and second display mechanisms 208*a* and 208*b* are positioned such that the first and second display plates 212*a* and 212*b* of the first and second display mechanisms are alternately positioned as described above. The processor causes the motors (not shown) to sequentially move the display plates 212*a* and 212*b* until a selected symbol on a display plate is indicated or displayed to a player. In FIG. 15A, the sequential movement of the display plates is illustrated where each of the display plates 212*a* and 212*b* move continuously from a first radial position 207 to a second radial position 209 until the movement of the display plates is stopped by the processor to indicate at least one selected symbol or image on the display plates of the display mechanisms to the player.

In this embodiment, the selected display plate 212*a* or 212*b* is displayed to a player in the first position 207. It should be appreciated that the selected display plate may be moved to and displayed to a player in any suitable position that is viewable by a player.

Referring to FIG. 15B, in one example, the processor selects two symbols or images to display to a player in a game. The processor then causes the display mechanisms to move the display plates in a wave-like pattern. The display mechanisms continue to move the display plates for a designated time period and then displays the display plates including the selected symbols to a player in the game. In this example, the first display plate 212*a* includes one of the selected symbols which is a value of one hundred (213*a*) and the second display plate 212*b* includes the other selected symbol which is a modifier or multiplier 2× (213*b*). It should be appreciated that the images included on the display plates may be any suitable images, symbols, values, modifiers, prizes, or any other suitable images, symbols or prizes desired by the game implementor. In this example, the indicated value of one hundred is multiplied by the multiplier 2× to provide a total award of two hundred to the player in the game. It should be appreciated that the symbols or images indicated by the display plates may be combined in any suitable manner to provide an outcome to the player in the game.

Figure 10:
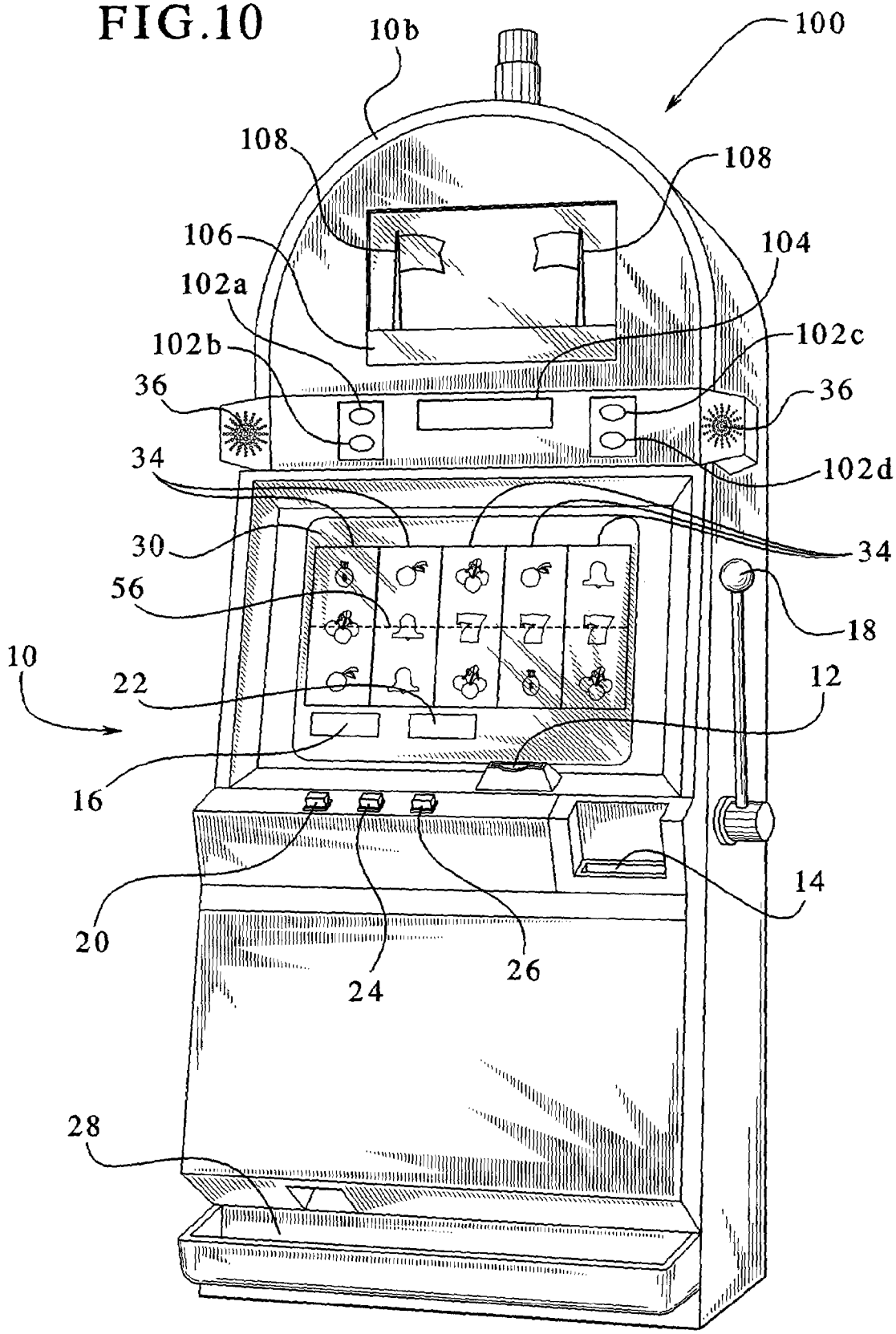
FIG. 10 is an elevation view of an alternative embodiment of the gaming device of the present invention illustrating a mechanical display device mounted to the top of the cabinet of the gaming device.
Figure 11:
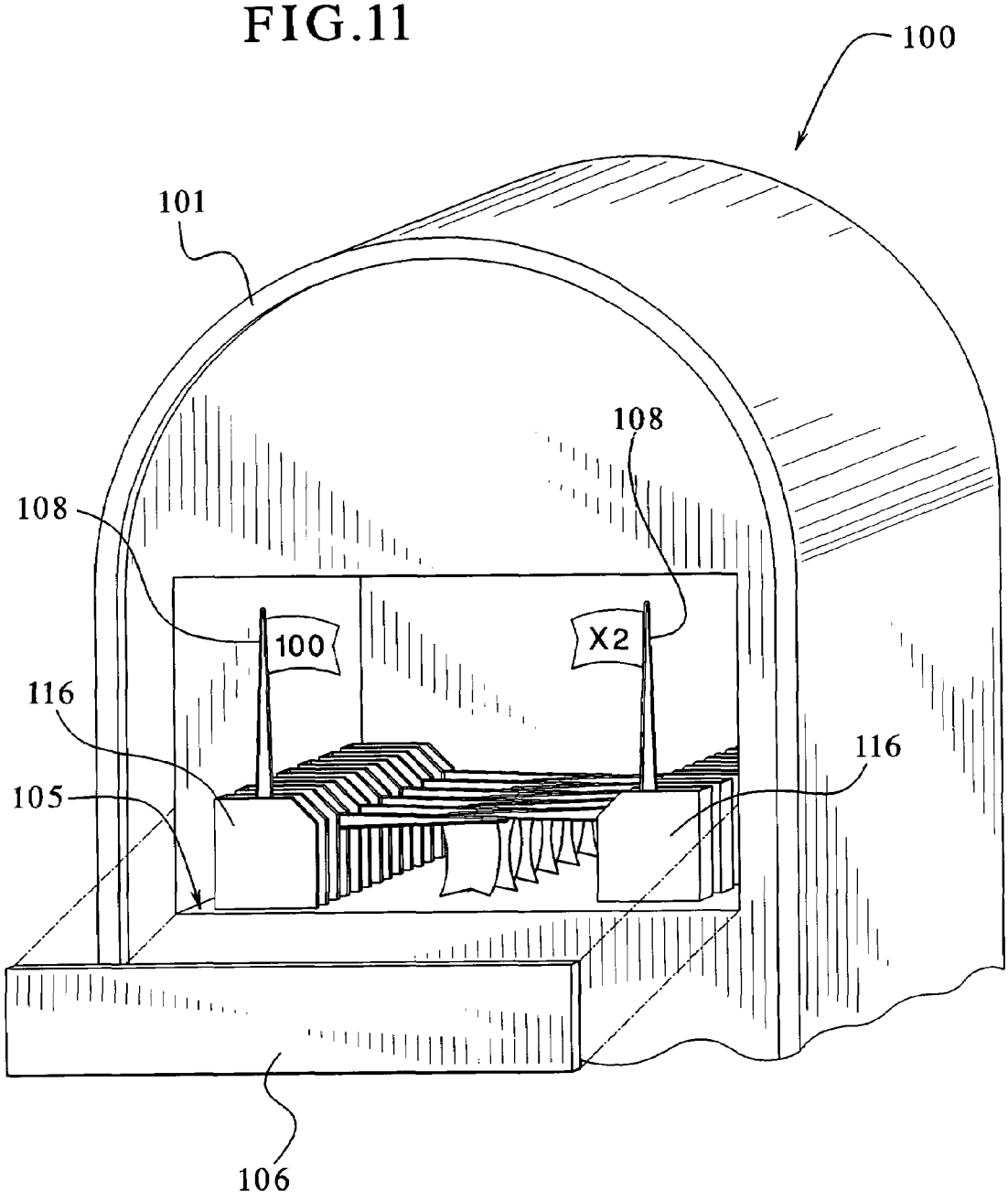
FIG. 11 is a front perspective view of the alternative embodiment of FIG. 10 illustrating the mechanical display device.

Referring now to FIG. 10, in one embodiment as described above, once the outcome such as the award or awards are indicated and displayed to a player, the gaming device enables the player to accept or reject the award or awards indicated by the display plates 112 of the display mechanisms 108. If the player accepts the award or awards indicated by the display mechanisms, the player presses or activates input 102*d* and the gaming device provides the award or awards to the player in the game.

If the player rejects the award or awards displayed to the player by the display mechanisms 108, the gaming device enables the player to choose one of three different options to cause the secondary mechanical display to display another award or awards to the player in the game. As described above, the player may choose to activate one of three inputs 102*a*, 102*b* or 102*c* located on the front of the gaming device. If the player presses and activates button 102*a*, the gaming device causes at least one of the display mechanisms 108 located on the left side of the housing (as the player views the housing from the front of the gaming device) to move to indicate or display another award to the player. The gaming device selects at least one award associated with the display plates of the display mechanisms to provide to the player and causes the display mechanism 108 which includes the selected award to display the award to the player so that the award is viewable by the player.

Alternatively, if the player presses and activates button 102*c*, the gaming device causes at least one of the display mechanisms 108 on the right side of the housing (as the player views the housing from the front of the gaming device) to move. The gaming device then selects an award associated with these display mechanisms and causes the display mechanism including that award to stop and indicated or display the selected award to the player in the game. In this embodiment, the gaming device stops the movement of the display plate so that the display plate is in the up position or position 207 as shown in FIG. 15A. The gaming device then provides the award indicated by the display plate of the display mechanism to the player.

The player may alternatively select button 102*b* which activates both sets of display mechanisms 108 so that both sets of display mechanisms are moving sequentially of in a wave-like pattern. In this embodiment, the display mechanisms 108 are positioned so that the display plates of the display mechanisms are alternatively positioned and moved so that each display plate of the display mechanisms are moving from a straight-up position such as position 207 and FIG. 15A to a down position such as position 209 and FIG. 15A. Each display mechanism causes each display plate to move up and down until the gaming device selects one or more of awards to display to the player. The gaming device then causes the display mechanism or mechanisms to display the selected awards to the player while obscuring the awards or hiding the awards on the display mechanism which do not include the selected awards. It should be appreciated that the display plates on the display mechanisms 108 may move in any suitable order or matter desired by the game implementor.

In a further alternative embodiment, the housing 101 or the frame 105 includes at least one Light Emitting Diode (L.E.D.), which directs light at one or more of the first and second display plates to better enable a player to view the first and second images on the first and second display plates. The housing or frame may include one or a plurality of L.E.D.'s to direct light at the display plates. In one embodiment, the L.E.D.'s are adjustable to direct light at a specific area in the housing or at a specific display plate or plates in a game. It should be appreciated that any suitable lighting mechanism may be used to illuminate and/or direct light at the first and second display plates in a game.

In another alternative embodiment, a light display (not shown), including at least one substantially transparent panel and at least one light panel, is positioned behind the first and second display plates and connected to the housing using a suitable connector or connectors. The substantially transparent panel is positioned adjacent to and in front of the light panel. In one embodiment, the light panel includes a plurality of L.E.D.'s which are attached to the light panel to form a picture or other suitable image such as an image associated with the theme or themes of a game. It should be appreciated that the picture or image may be any suitable picture or image desired by the game implementor. In one embodiment, the substantially transparent panel includes an opaque coating or tinted coating which prevents a player from viewing the L.E.D.'s until the L.E.D.'s are illuminated in a game. Once the L.E.D.'s are illuminated, the picture or image formed by the L.E.D.'s becomes visible and viewable by a player in the game.

In one embodiment, the L.E.D.'s are controlled by the processor to illuminate at designated time or times in a game such as when an image or images are indicated to a player or when any other suitable game function occurs in the game. In another embodiment, each of the L.E.D.'s are independently illuminated by the processor. In this embodiment, one or more of the L.E.D.'s may be illuminated at same time or different times to create different visual effects in a game or games. For example, the L.E.D.'s may be positioned to create an image or picture of fireworks exploding behind the display plates. In this example, one or more of the L.E.D.'s may be alternately illuminated to show one or more fireworks traveling upward on the light panel away from the bottom panel 107*e* of the frame 105. The L.E.D.'s are then simultaneously or alternately illuminated by the processor to show fireworks exploding on the light panel. In one embodiment, the L.E.D.'s include different color L.E.D.'s where L.E.D.'s including the same color or different colors may be illuminated to further enhance the visual effects of the L.E.D's in a game or games.

It should thus be understood that the mechanical display of the present invention may be used with a variety of gaming devices such as video poker machines, slot machines, blackjack machines, and keno machines.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the pending claims.

The invention is claimed as follows:

1. A gaming device comprising:

a housing;

a game operable upon a wager by a player;

a plurality of first display plates independently movably connected to the housing, said first display plates including a plurality of first symbols;

a plurality of second display plates independently movably connected to the housing, said second display plates including a plurality of second symbols, wherein the second display plates are connected to the housing in opposing relation to the first display plates, and wherein a plurality of the first display plates and the second display plates are adapted to simultaneously move towards and away from each other to indicate at least one of the first symbols and the second symbols to the player; and an award adapted to be provided to the player, wherein the award is based on any indicated first and second symbols on the first and second display plates after the display plates stop moving.

2. The gaming device of claim 1, wherein the first display plates include a first axis of rotation and the second display plates include a second axis of rotation, wherein the first and second axes of rotation are different.

3. The gaming device of claim 1, wherein the first display plates each include a first axis of rotation and the second display plates each include a second axis of rotation, and wherein at least one of the first axes of rotation and at least one of the second axes of rotation are different.

4. The gaming device of claim 3, wherein at least two of the first axes of rotation are different.

5. The gaming device of claim 4, wherein each of the first and second display plates are positioned in different horizontal planes.

6. The gaming device of claim 3, wherein at least two of the second axes of rotation are different.

7. The gaming device of claim 6, wherein each of the first and second display plates are positioned in different horizontal planes.

8. The gaming device of claim 1, wherein the first display plates include a plurality of first actuators connected to the housing and the second display plates include a plurality of second actuators connected to the housing, said first and second actuators being operable to independently move each of the first and second display plates.

9. The gaming device of claim 1, wherein said first and second symbols are selected from the group consisting of: values, awards, prizes, game elements and modifiers.

10. The gaming device of claim 1, wherein said first and second symbols include images of conventional playing cards.

11. The gaming device of claim 1, wherein each of the first and second display plates are positioned in different horizontal planes.

12. The gaming device of claim 1, which includes a substantially non-transparent panel connected to the front of the housing and positioned in front of the first and second display plates, wherein said panel prevents a player from viewing the first and second images on the first and second display plates when the first and second display plates are moved behind the panel.

13. The gaming device of claim 1, wherein at least one of the first display plates at least partially obscures at least one of the second display plates when the first and second display plates move toward and away from each other.

14. A gaming device comprising:

a housing;

a game operable upon a wager by a player;

a plurality of first display plates including a plurality of first symbols, said first display plates including a plurality of first actuators connected to the housing, said first actuators adapted to independently move said first display plates;

a plurality of second display plates including a plurality of second symbols, said second display plates including a plurality of second actuators connected to the housing, said second actuators adapted to independently move said second display plates; and a processor operable with said first and second actuators upon a triggering event to: (a) select at least one of the first and second symbols to be indicated by the first and second display plates; (b) cause said first and second actuators to independently move toward and away from each other to indicate any selected first and second symbols; and (c) provide an award to the player based on the indicated first and second symbols after the display plates stop moving.

15. The gaming device of claim 14, wherein the first display plates include a first axis of rotation and the second display plates include a second axis of rotation, wherein the first and second axes of rotation are different.

16. The gaming device of claim 14, wherein the first display plates each include a first axis of rotation and the second display plates each include a second axis of rotation, and wherein at least one of the first axes of rotation and at least one of the second axes of rotation are different.

17. The gaming device of claim 16, wherein at least two of the first axes of rotation are different.

18. The gaming device of claim 17, wherein each of the first and second display plates are positioned in different horizontal planes.

19. The gaming device of claim 16, wherein at least two of the second axes of rotation are different.

20. The gaming device of claim 19, wherein each of the first and second display plates are positioned in different horizontal planes.

21. The gaming device of claim 14, wherein said first and second symbols are selected from the group consisting of: values, awards, prizes, game elements and modifiers.

22. The gaming device of claim 14, wherein said first and second symbols include images of conventional playing cards.

23. The gaming device of claim 14, wherein the housing encloses the plurality of first and second display plates.

24. The gaming device of claim 14, which includes a substantially non-transparent panel connected to the front of the housing and positioned in front of the first and second display plates, wherein said panel prevents a player from viewing the first and second images on the first and second display plates when the first and second display plates are moved behind the panel.

25. The gaming device of claim 14, wherein at least one of the first display plates at least partially obscures at least one of the second display plates when the first and second display plates move toward and away from each other.

26. A method for operating a gaming device including a game operable upon a wager, said method comprising:

(a) independently moving a plurality of first display plates including a plurality of first symbols and a plurality of second display plates including a plurality of second symbols towards and away from each other, wherein said first and second display plates are adapted to be independently movably connected to a housing, and wherein said first display plates are positioned in opposing relation to said second display plates on the housing;

(b) selecting at least one of the first symbols on the plurality of first display plates and the second symbols on the plurality of second display plates to be indicated to a player;

(c) indicating the selected first and second symbols by independently moving the first and second display plates including said selected first and second symbols to be viewable by the player; and (d) providing an award to the player after the display plates stop moving, wherein the award is based on the indicated first and second symbols.

27. The method of claim 26, which includes selecting the first and second symbols from the group consisting of: values, awards, prizes and modifiers.

28. The method of claim 26, wherein said first and second symbols include images of conventional playing cards.

29. The method of claim 26, which includes moving the first and second display plates including the non-selected first and second symbols behind a substantially non-transparent panel connected to the housing.

30. The method of claim 26, wherein indicating the selected first and second symbols includes sequentially moving the first and second display plates to indicate the selected first and second symbols to the player.

31. A gaming device comprising:

a housing;

a game operable upon a wager by a player;

a plurality of first display plates independently movably connected to the housing, said first display plates including a plurality of first symbols;

a plurality of second display plates independently movably connected to the housing, said second display plates including a plurality of second symbols, wherein the first display plates are interspersed with and in opposing relation to the second display plates so that at least one of the first display plates blocks at least a part of the first or second symbol displayed by at least one other of the second display plates when said plates are in designated position, and wherein a plurality of the first display plates and the second display plates are adapted to simultaneously move towards and away from each other to indicate at least one of the first symbols and second symbols to the player; and an award adapted to be provided to the player, wherein the award is based on any indicated first and second symbols on the first and second display plates after the first and second display plates stop moving.

32. The gaming device of claim 31, wherein the first display plates include a first axis of rotation and the second display plates include a second axis of rotation, wherein the first and second axes of rotation are different.

33. The gaming device of claim 31, wherein the first display plates each include a first axis of rotation and the second display plates each include a second axis of rotation, and wherein at least one of the first axes of rotation and at least one of the second axes of rotation are different.

34. The gaming device of claim 33, wherein at least two of the first axes of rotation are different.

35. The gaming device of claim 34, wherein each of the first and second display plates are positioned in different horizontal planes.

36. The gaming device of claim 33, wherein at least two of the second axes of rotation are different.

37. The gaming device of claim 36, wherein each of the first and second display plates are positioned in different horizontal planes.

38. The gaming device of claim 31, wherein the first display plates include a plurality of first actuators connected to the housing and the second display plates include a plurality of second actuators connected to the housing, said first and second actuators being operable to independently move each of the first and second display plates.

39. The gaming device of claim 31, wherein said first and second symbols are selected from the group consisting of: values, awards, prizes, game elements and modifiers.

40. The gaming device of claim 31, wherein said first and second symbols include images of conventional playing cards.

41. The gaming device of claim 31, wherein each of the first and second display plates are positioned in different horizontal planes.

42. The gaming device of claim 31, which includes a substantially non-transparent panel connected to the front of the housing and positioned in front of the first and second display plates, wherein said panel prevents a player from viewing the first and second images on the first and second display plates when the first and second display plates are moved behind the panel.

* * * * *

UNITED STATES PATENT AND TRADEMARK OFFICE

CERTIFICATE OF CORRECTION

PATENT NO. : 7,338,366 B2
APPLICATION NO. : 10/661685
DATED : March 4, 2008
INVENTOR(S) : Tai Rosander et al.

It is certified that error appears in the above-identified patent and that said Letters Patent is hereby corrected as shown below:

IN THE SPECIFICATION:

In Column 15, Line 1 change second occurrence, “of” to --or--.

Signed and Sealed this

Twenty-third Day of September, 2008

JON W. DUDAS
*Director of the United States Patent and Trademark Office*